US009829185B2

(12) United States Patent
Spiro

(10) Patent No.: US 9,829,185 B2
(45) Date of Patent: Nov. 28, 2017

(54) INTERMEDIATE DEVICE STRUCTURE FOR ILLUMINATION POLES AND A METHOD OF USE THEREOF

(71) Applicant: Exposure Illumination Architects, Inc., Scottsdale, AZ (US)

(72) Inventor: Daniel S. Spiro, Scottsdale, AZ (US)

( * ) Notice: Subject to any disclaimer, the term of this patent is extended or adjusted under 35 U.S.C. 154(b) by 504 days.

(21) Appl. No.: 14/166,056

(22) Filed: Jan. 28, 2014

(65) Prior Publication Data

US 2014/0211487 A1 Jul. 31, 2014

Related U.S. Application Data

(60) Provisional application No. 61/757,340, filed on Jan. 28, 2013, provisional application No. 61/767,035, filed on Feb. 20, 2013.

(51) Int. Cl.

| | |
|---|---|
| ***F21S 8/00*** | (2006.01) |
| ***F21V 23/06*** | (2006.01) |
| ***F21S 8/08*** | (2006.01) |
| ***F21V 23/04*** | (2006.01) |
| ***F21V 29/74*** | (2015.01) |
| *F21W 131/103* | (2006.01) |

(52) U.S. Cl.

CPC ..... *F21V 23/06* (2013.01); *F21S 8/086* (2013.01); *F21V 23/0442* (2013.01); *F21V 29/74* (2015.01); *F21W 2131/103* (2013.01); *Y10T 29/49117* (2015.01)

(58) Field of Classification Search

CPC ..... Y02B 20/42; Y02B 20/72; Y02B 20/40; F21S 8/085; F21S 8/088; F21S 9/035; F21S 9/043; F21W 2131/103; H04W 84/18; H05B 37/0272; H05B 37/034

USPC ..... 362/431; 455/507; 340/635

See application file for complete search history.

(56) References Cited

U.S. PATENT DOCUMENTS 6,307,330 B1 10/2001 So
RE38,767 E 8/2005 Wedell et al.
(Continued)

FOREIGN PATENT DOCUMENTS

WO 20130011485 A1 1/2013

OTHER PUBLICATIONS

Patent Cooperation Treaty, International Search Report and the Written Opinion of the International Search Authority, or the Declaration for PCT/US14/13369, dated Apr. 28, 2014, USA.

*Primary Examiner* — William Carter

(74) *Attorney, Agent, or Firm* — Schmeiser, Olsen & Watts LLP

(57) ABSTRACT

An intermediate device structure/system is provided. The system includes a base member and a coupler, the coupler arm being coupled to the base member and extending therefrom. The system further includes a housing configured to functionally engage the base member, the housing defining therein a cavity therein for housing electrical components of the system, including a control unit and other auxiliary devices. The base member may be coupled to a mast arm of an illumination pole and the coupler arm may be coupled to a luminaire of the illumination pole, such that the intermediate device system is configured in line between the mast arm and the luminaire. The control unit is electrically coupled to the electrical power of an illumination pole and powers the data and power connectivity between devices belonging to the intermediate device system.

17 Claims, 17 Drawing Sheets

(56) References Cited

U.S. PATENT DOCUMENTS

| | | | | |
|---|---|---|---|---|
| 9,363,861 | B2 * | 6/2016 | Chalmers | H05B 37/02 |
| 2008/0310850 | A1 * | 12/2008 | Pederson | G07C 9/00158 398/135 |
| 2012/0038281 | A1 * | 2/2012 | Verfuerth | H05B 37/0272 315/152 |
| 2012/0044350 | A1 | 2/2012 | Verfuerth | |
| 2012/0250302 | A1 | 10/2012 | Edwards et al. | |
| 2013/0088864 | A1 * | 4/2013 | Verdes | F21V 29/004 362/235 |
| 2014/0036521 | A1 * | 2/2014 | Elliott | F21V 21/116 362/459 |

* cited by examiner

INTERMEDIATE DEVICE STRUCTURE FOR ILLUMINATION POLES AND A METHOD OF USE THEREOF

CROSS REFERENCE TO RELATED APPLICATIONS

This application claims priority to U.S. Provisional Patent Application to Spiro entitled "INTERMEDIATE DEVICE STRUCTURE," Ser. No. 61/757,340, filed Jan. 28, 2013, and to U.S. Provisional Patent Application to Spiro entitled "INTERMEDIATE DEVICE STRUCTURE," Ser. No. 61/767,035, filed Feb. 20, 2013, the disclosures of which are hereby incorporated entirely herein by reference.

BACKGROUND

Technical Field

This disclosure relates generally to roadway/street poles and in particular to an intermediate device structure and method that converts a conventional illumination pole into a "smart" pole.

State of the Art

Street poles dot our modern landscape, from city parks to parking lots and from pedestrian walkways to commuter roadways, just to name a few. Some of these street poles are also illumination poles. Illumination poles serve to illuminate their respective surroundings to provide visibility in darkly lit environments and/or during the night hours when there is a natural absence of light. By supplying visibility in environments otherwise low on light, these illumination poles provide value to a community through an added measure of safety, security, and convenience.

With particular reference to roadways, illumination poles can be set up at intersections to assist both vehicle and pedestrian traffic in safely navigating the intersection in low-light settings. In addition thereto, illumination poles can be set up along roadways at predetermined intervals, depending on the illumination capabilities of the luminaire attached to the pole and the light intensity desired by the municipality, to assist both vehicle and pedestrian traffic along the roadway. City parks, parking lots, garages, walking paths, and other common areas also utilize illumination poles in a similar fashion.

But with the advent of the technological revolution, including advances in power generation, power distribution, and power and data connectivity as well as a variety of electronic devices having increasingly better processing capabilities and connectivity, municipalities are beginning to use these advances to transform their respective landscapes into "smarter" landscapes. For example, conventional traffic lights and conventional illumination poles, and their accompanying structure, are becoming increasingly populated with additional lighting and non-lighting related devices that improve the lights' and poles' collective utility to the community. Cameras are sometimes mounted on traffic lights to monitor traffic flow. Photocells are sometimes mounted on illumination poles to automate the activation of light from the luminaire in low-light conditions.

However, this transformation of the traffic light or the illumination pole to include additional lighting and/or non-lighting related devices is not without problems. Consider, for example, that adding, removing, or somehow altering components of the illumination pole may compromise the structural integrity of the pole itself. Changes to the illumination pole may create structural weaknesses or introduce susceptibility to corrosion. Also, changes to the illumination pole may not only diminish the aesthetic architectural appeal originally intended by the designer but also degrade the uniformity and beauty of the illumination poles chosen by the municipality. Mounting after-market cameras and/or additional products to an illumination pole may diminish the original aesthetic appeal by creating unsightly structural configurations and wiring and by introducing unpleasant disparity between poles.

In addition, changes to the illumination pole may prevent the proliferation of additional improvements and/or components due to inadequate space allocation on the pole. For example, a device manufacturer's interest in the illumination pole is limited to its respective discipline. If, therefore, one device is added to the pole that monopolizes space allocation, then it could be possible that other device manufacturers may be dissuaded from pursuing future improvements to the pole due to the lack of space. In other words, the first discipline to occupy the pole could do so at the expense of other disciplines to follow. Such inefficiency is not beneficial to the municipality or the citizens thereof.

The lighting industry is transforming from electromagnetic to electronic technology. Similarly, electronic technology is developing electronic devices with increasingly better processing capabilities and connectivity. Yet, despite the lighting industry becoming more and more interested on incorporating intelligent systems or "smart" systems to provide a variety of lighting system functions, few advances have been made in developing efficient, economical, and aesthetically pleasing smart illumination poles, due at least in part to historical legacy, complexity, and cost. Each individual developer of design improvements carries with it costs associated with research and development, upfront equipment purchase, installation, operation, and maintenance.

In view of the foregoing, there is thus a need in the lighting industry for an apparatus that can establish standards and methods for device cohabitation on illumination poles, as these poles are increasingly included in the smart grid revolution. The present disclosure addresses these concerns.

SUMMARY

The present disclosure relates to roadway poles and in particular to an intermediate device structure and method that converts a conventional pole or conventional illumination pole into a "smart" pole that may employ a myriad of sensing, signaling, communicating, alerting, monitoring, surveying, and illuminating devices that allow the smart pole to control its own functions and communicate with surrounding "smart" poles and/or other remote devices.

An aspect of the present disclosure includes an intermediate device system for an illumination pole comprising a base member having a first end and a second end, a coupler arm having a first end and a second end, the coupler arm being coupled to the base member and extending therefrom, and a housing configured to functionally engage the base member, the housing defining therein a cavity, wherein the second end of the base member is configured to functionally engage a mast arm of the illumination pole, and wherein the first end of the coupler arm is configured to functionally engage a luminaire of the illumination pole, such that the intermediate device system is configured in line between the mast arm and the luminaire.

Another aspect of the present disclosure includes wherein the base member defines therein a through bore from the first end of the base member to the second end of the base member, and wherein the coupler arm defines therein a through bore from the first end of the coupler arm to the second end of the coupler arm.

Another aspect of the present disclosure includes wherein the base member first end and the coupler arm second end are fixedly coupled to one another, and the through bore of the base member and the through bore of the coupler arm are axially aligned.

Another aspect of the present disclosure includes wherein the through bore of the base member is configured to receive and functionally engage the mast arm of the illumination pole.

Another aspect of the present disclosure includes wherein the first end of the coupler arm is configured to be inserted into a bore of the luminaire to functionally engage the luminaire.

Another aspect of the present disclosure includes wherein the housing is configured to releasably engage the base member.

Another aspect of the present disclosure includes wherein the housing further comprises a housing body and a housing covering, the housing covering being configured to releasably couple to the housing body.

Another aspect of the present disclosure includes wherein the housing body further comprises one or more fins on an exterior surface thereof, the fins being spaced apart from one another for heat dissipation.

Another aspect of the present disclosure includes wherein the housing cover further comprises one or more fins on an exterior surface thereof, the fins being spaced apart from one another for heat dissipation.

Another aspect of the present disclosure includes wherein the housing body further comprises one or more vents in an exterior surface thereof for ingress and egress of air while resisting ingress and egress of moisture and dust.

Another aspect of the present disclosure includes wherein the housing body further comprises one or more data connectivity points for coupling thereto auxiliary electronic devices.

Another aspect of the present disclosure includes the housing further comprising an internal ridge that protrudes into the cavity, the internal ridge defining an external channel in a bottom surface of the housing, the external channel being configured to functionally engage the base member.

Another aspect of the present disclosure includes wherein the base member defines therein a base member opening, and wherein the internal ridge defines therein a ridge opening, the base member opening and the ridge opening being in communication with one another when the housing is coupled to the base member.

Another aspect of the present disclosure includes a control unit electrically coupled to a power supply of the illumination pole, the control unit being configured to govern power and data connectivity of electronic components of the intermediate device system.

Another aspect of the present disclosure includes wherein the electrical components comprise one or more of a processor, a power source, a communication module, memory, an optical device, an auditory device, and wireless connectivity components.

Another aspect of the present disclosure includes a method of building a smart illumination pole, the method comprising removing a luminaire from a mast arm of an illumination pole, inserting an intermediate device system on the mast arm, inserting the luminaire of the intermediate device system, such that the intermediate device system is positioned in line between the mast arm and the luminaire, electrically the intermediate device system to existing wiring on the illumination pole.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

The conventional street pole or public utility pole is a largely untapped vertical real estate asset that communities, municipalities, and device manufacturers alike can begin to develop to increase economic value to both the government and private sector as well as improve quality of life for ordinary citizens, and particularly those in urban settings.

Figure 1A:
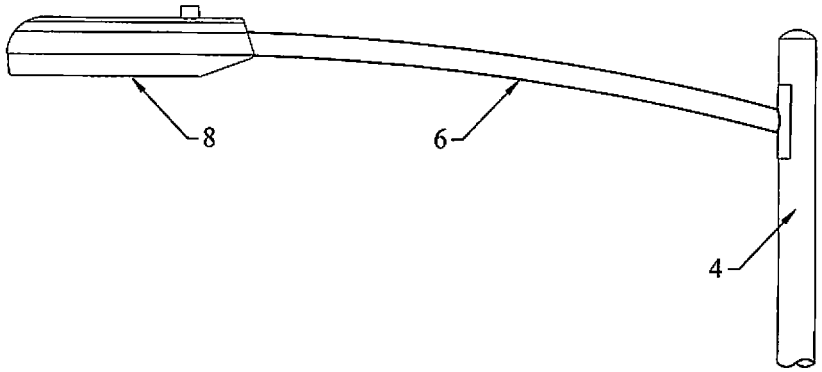
FIG. 1A is a side view of components of a conventional illumination pole in accordance with the present disclosure.
Figure 1B:
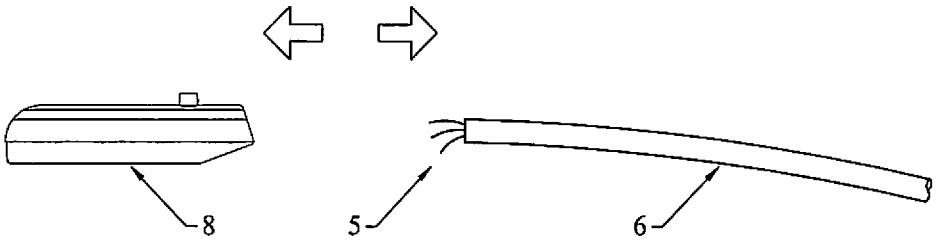
FIG. 1B is an exploded side view of components of the conventional illumination pole shown in FIG. 1, in accordance with the present disclosure.

As shown in FIGS. 1A and 1B, a conventional pole 2 (herein depicted and described as an illumination pole) may comprise pole 4, mast arm 6 that connects to pole 4, and luminaire 8 that physically couples to mast arm 6 at another end of mast arm 6 not connected to pole 4. One end of pole 4 may be imbedded in a ground or grade surface 3 or coupled to surface 3 by an additional support structure, such as a cement slab, to ensure that pole 4 may rise vertically from surface 3 into the air. Mast arm 6 can typically be coupled to pole 4 near the top of pole 4 or at least at a height thereof that is sufficient to permit luminaire 8 to provide the desired amount of light to the surrounding area near illumination pole 2. Conventional illumination pole 2 may further comprise electrical wiring 5 running from the municipality's electric grid through pole 4 and mast arm 6 to luminaire 8 to electrically connect and power luminaire 8.

As a result of the preconfigured electric grid and each conventional illumination pole's established electric connectivity thereto, each conventional illumination pole 2 is currently underutilized as an electrified vertical real estate asset of the community. In other words, the full value of illumination pole 2 as a housing for smart devices and as an integral component of an overall smart grid of any particular community is not yet realized. However, the intermediate device structure (IDS) of the present disclosure for use with illumination poles 2 can standardize the means and methods of maximizing this largely-dormant electrified vertical resource.

Figure 2D:
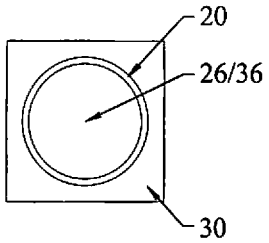
FIG. 2D is a front view of the components of an embodiment of an intermediate device structure/system shown in FIG. 2A, in accordance with the present disclosure.
Figure 2A:
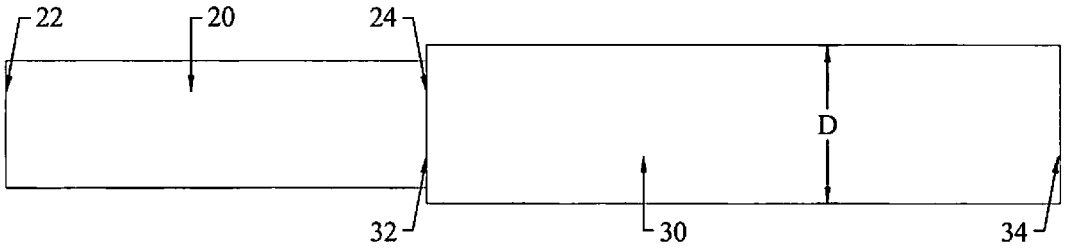
FIG. 2A is a side view of components of an embodiment of an intermediate device structure/system in accordance with the present disclosure.
Figure 2B:
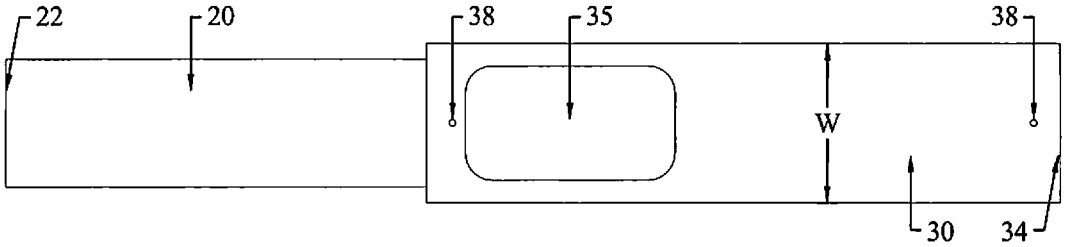
FIG. 2B is a top view of the components of an embodiment of an intermediate device structure/system shown in FIG. 2A, in accordance with the present disclosure.
Figure 2C:
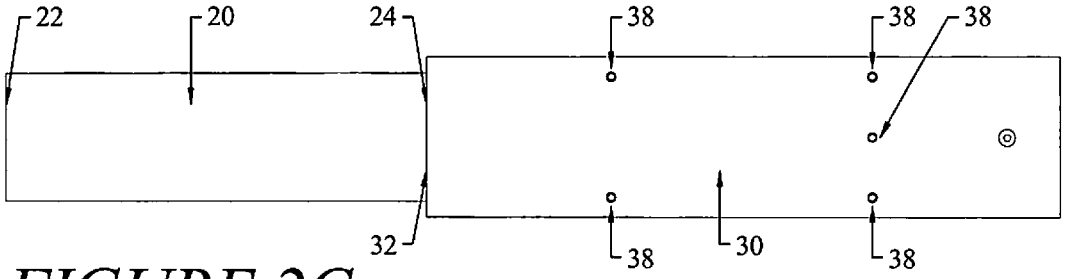
FIG. 2C is a bottom view of the components of an embodiment of an intermediate device structure/system shown in FIG. 2A, in accordance with the present disclosure.
Figure 3:
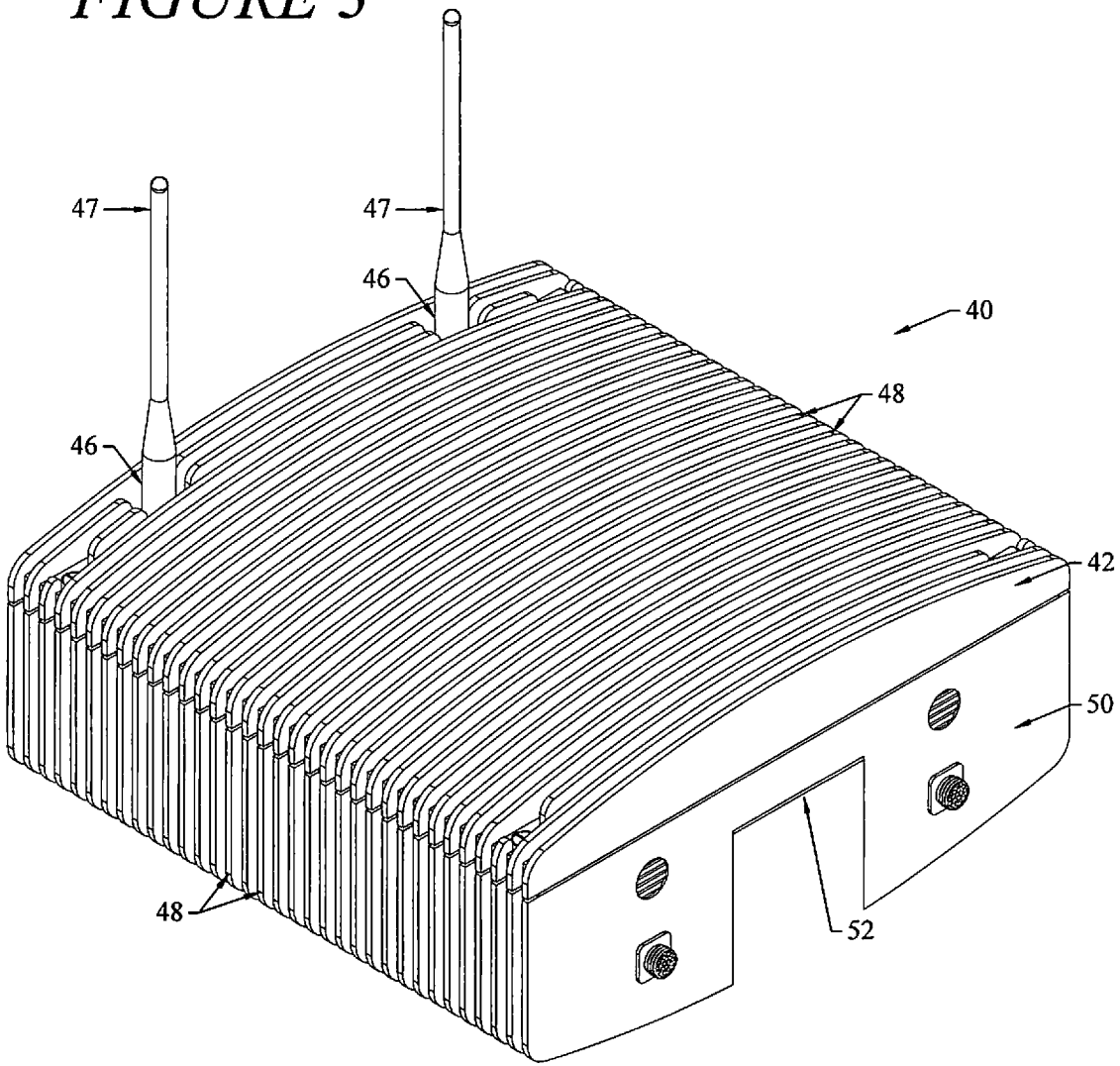
FIG. 3 is a top perspective view of components of an embodiment of an intermediate device structure/system in accordance with the present disclosure.

Referring to the drawings, FIGS. 2A-3 depict various components of an embodiment of an intermediate device system (IDS) 10 that may be utilized in conjunction with an illumination pole 2. Coupling IDS 10 to conventional illumination pole 2 converts pole 2 into smart pole 140. Embodiments of IDS 10 may comprise various structural and functional components that complement one another to provide the unique functionality and performance of IDS 10, the structure and function of which will be described in greater detail herein. Components of IDS 10 may comprise, among others, coupling arm 20, base member 30 and housing 40, each of which is to be discussed in greater detail herein.

With reference to FIGS. 2A-2D, embodiments of IDS 10 may comprise coupling arm 20. Coupling arm 20 may comprise a generally cylindrical shape having an axial length defined between a first end 22 and a second end 24. Coupling arm 20 may have a through bore 26 running from first end 22 to second end 24. Coupling arm 20 may define an outer diameter 28. Coupling arm 20 may have a size and shape that approximates the shape and size of mast arm 6 of conventional illumination pole 2. Outer diameter 28 of coupling arm 20 may taper from either first end 22 to second end 24 or from second end 24 to first end 22, such that outer diameter 28 is not constant along an axial length of coupling arm 20. In alternative embodiments, coupling arm 20 may have a constant cylindrical outer diameter 28. In yet further alternative architectural configurations, coupling arm 20 need not be cylindrical in shape, but may instead be any other suitable three-dimensional shape. Additionally, coupling arm 20 may be expanded both axially and radially to accommodate device scalability.

Embodiments of IDS 10 may comprise base member 30. Base member 30 may comprise a generally rectangular shape having a length defined between a first end 32 and a second end 34. Base member 30 may have a through bore 36 running from first end 32 to second end 34. Base member 30 may define an outer width W, as depicted in FIG. 2B. Base member 30 may also define an outer depth D, as depicted in FIG. 2A. In yet further alternative architectural configurations, base member 30 need not be rectangular in shape, but may instead be any other suitable three-dimensional shape. Additionally, base member 30 may be expanded both vertically and horizontally to accommodate device scalability. Base member 30 may further define an access opening 35 in a top surface, as depicted in FIG. 2B. Access opening 35 may be a substantially large opening that provides easy access from the exterior of base member 30 to the interior of through bore 36. Base member 30 may further define one or more bores 38 therein in one or more sides thereof, as depicted in FIGS. 2B and 2C. Bores 38 may be a hole, passageway, or other opening which can serve as an attachment point for additional components of IDS 10. Embodiments of the IDS 10 may further comprise through bore 26 and through bore 36 being axially aligned, as depicted in FIG. 2D.

Embodiments of IDS 10 may further comprise base member 30 being configured to be functionally and/or structurally coupled to coupling arm 20, and in particular second end 24 of coupling arm 20 may be coupled to first end 32 of base member 30 such that coupling arm 20 and base member 30 are structurally and functionally secured to one another thereby. Embodiments of IDS 10 may further comprise coupling arm 20 and base member 30 being assembled by joining casted and non-casted elements together. Alternatively, coupling arm 20 and base member 30 may be monolithically casted or printed in a unitary or single piece. Coupling arm 20 and base member 30 may be manufactured from a heat dissipating, non-corrosive material and may be painted or otherwise treated to suit architectural needs. The configuration of IDS 10 provides a rigid design suitable in adverse environments.

Embodiments of IDS 10 may comprise coupling arm 20 being configured to receive and retain thereon luminaire 8 and base member 30 being configured to receive and retain therein mast arm 6. In other words, embodiments of IDS 10 may comprise coupling arm 20 and base member 30 being configured to be inserted between and oriented in line with mast arm 6 and luminaire 8 of illumination pole 2. Conventional illumination poles 2 used on roadways are typically configured to have mast arm 6 extend over the street and sidewalk such that luminaire 8 is deployed over vehicle and pedestrian traffic. Industry standards have harmonized the arm tip dimensions of mast arm 6 so manufacturers of luminaires 8 may build luminaires 8 to fit the standard mast arm 6. The tip of mast arm 6 is therefore dimensionally common to most roadway luminaires 8. As a result, first end 22 of coupling arm 20 may be physically and functionally shaped and sized to functionally engage luminaire 8. Once assembled in this way, coupling arm 20 and luminaire 8 may thereafter be retained on one another by fastening means, such as screws, bolts, mechanical clasps, friction fit, and the like. In like manner, through bore 36 of base member 30 may be physically and functionally shaped and sized to functionally engage the tip end of mast arm 6 of conventional illumination pole 2. Base member 30 may therefore be configured to receive mast arm 6 within through bore 36. In particular, second end 34 of base member 30 may be inserted onto mast arm 6 and base member 30 and mast arm 6 may thereby be coupled to one another by fastening means, such as screws, bolts, mechanical clasps, friction fit, and the like. Any of the fastening means described herein may further comprise sealing members, such as neoprene-like washers, that may function together with the fastener and/or the bores 36 to seal the junction between component parts against moisture ingress.

With reference to FIGS. 3-6, embodiments of IDS 10 may comprise housing 40, which may further comprise, among additional components, a housing cover 42 and a housing body 50. Housing cover 42 and housing body 50 may each be manufactured from a heat dissipating, non-corrosive material and may be painted or otherwise treated to suit architectural needs and to withstand outdoor environments. Embodiments of IDS 10 may further comprise housing body 50 being integrally formed with coupling arm 20 and base member 30, such that housing body 50, coupling arm 20 and base member 30 are a single unitary piece of material, such material perhaps being a heat dissipating, non-corrosive material and may be painted or otherwise treated to suit architectural needs and to withstand outdoor environments With reference to FIG. 3, embodiments of IDS 10 may further comprise housing cover 42 and housing body 50 being configured to functionally engage and couple to one another. For example, housing cover 42 may include an underside surface 44 and an internal step 45 on the perimeter of underside surface 44. Internal step 45 may be configured to compliment and cooperate with a raised lip 55 on the exterior perimeter of housing body 50. A sealing member, such as an O-ring gasket, may be configured between housing cover 42 and housing body 50. The sealing member may take the shape of internal step 45 or raised lip 55. Therefore, under the condition that housing cover 42 is placed over housing body 50, with the sealing member positioned therebetween, internal step 45 may functionally engage raised lip 55, or vice versa, to create a weather-proof or moisture-resistant seal between housing body 50 and housing cover 42 to establish a moisture-resistant housing 40. Housing cover 42 and housing body 50 may further comprise corresponding bores 38 that are configured to permit housing cover 42 and housing body 50 to be coupled to one another by fastening members, such as screws, bolts, mechanical clasps, friction fit, and/or the like.

Figure 4:
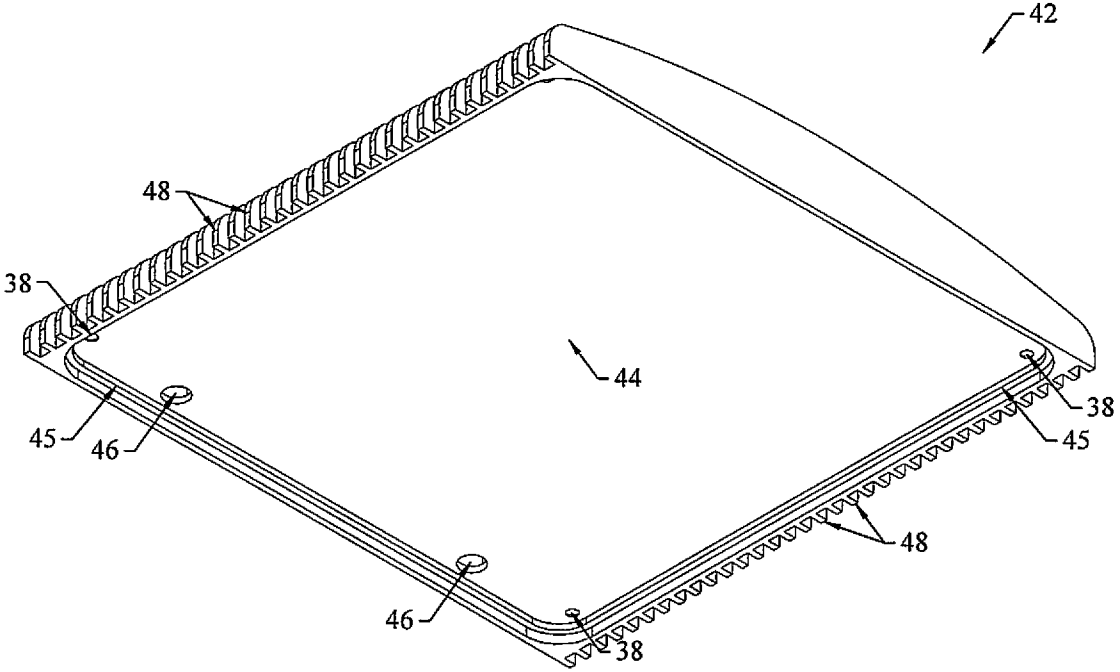
FIG. 4 is a bottom perspective view of components of an embodiment of an intermediate device structure/system in accordance with the present disclosure.

With reference to FIG. 4, embodiments of IDS 10 may further comprise underside surface 44, and essentially the entire housing cover 42, being configured to function as a heat sink for any heat generated by components that may be housed within housing 40. Underside surface 44 may be configured to draw heat out of housing 40 and dissipate that heat away from housing 40 via fins 48 positioned on exterior surfaces of housing 40. In particular, one or more fins 48 may be positioned on the top and side exterior surfaces of housing cover 42. Additionally, fins 48 may be generally uniformly distributed about both a top exterior surface and opposing side surfaces of housing cover 42. A plurality of fins 48 may serve to maximize airflow across housing cover 42 and thereby facilitate effective heat dissipation. Housing cover 42 may further comprise access ports 46 for wired power and data access into and out of the interior of housing 40.

With reference again to FIG. 3, embodiments of IDS 10 may further comprise housing body 50 including one or more fins 48 on one or more exterior surfaces thereof for facilitating heat dissipation from housing 40. As stated, fins 48 may be generally uniformly distributed about opposing side surfaces of housing body 50. A plurality of fins 48 may serve to maximize airflow across housing body 50 and thereby effectively aid in heat dissipation from housing 40.

Figure 5:
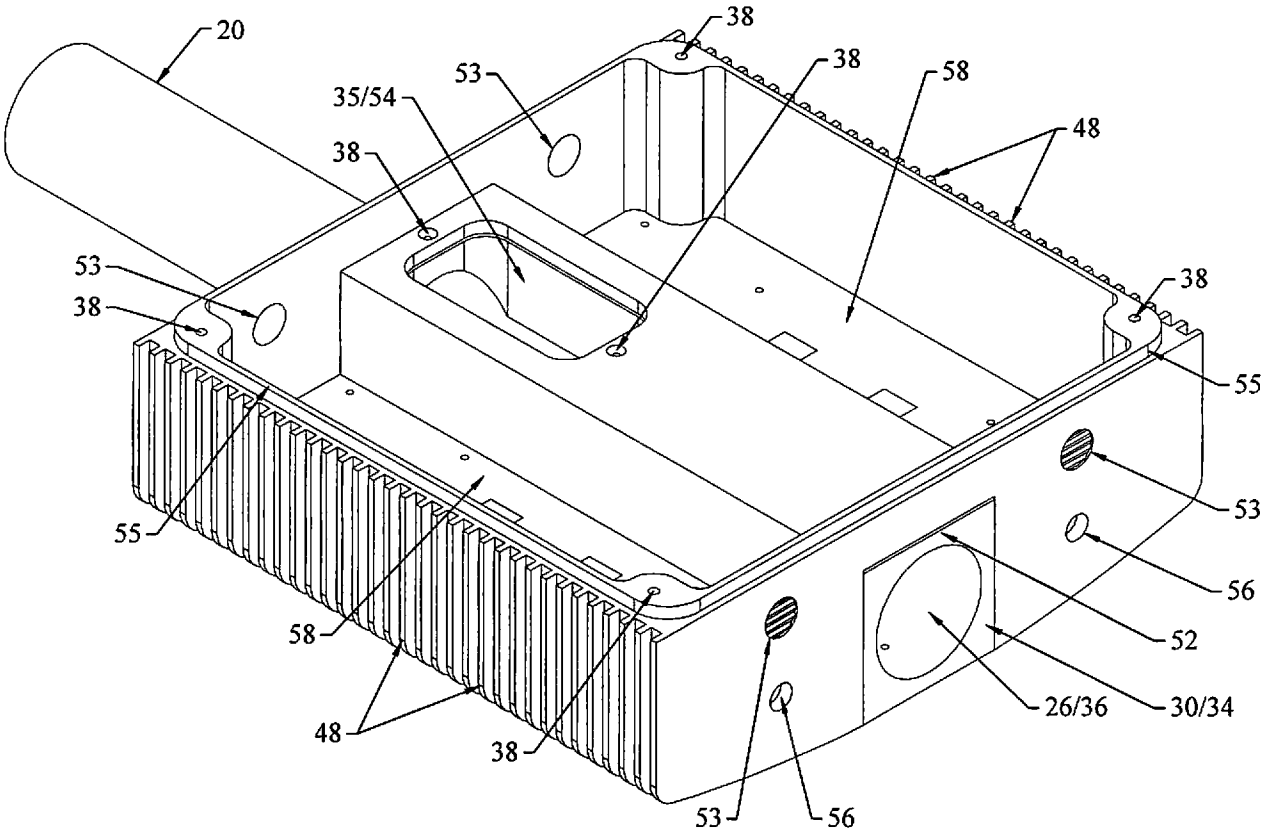
FIG. 5 is a top perspective view of components of an embodiment of an intermediate device structure/system in accordance with the present disclosure.

With reference to FIGS. 3 and 5, embodiments of IDS 10 may further comprise housing body 50 including an internal ridge 52 positioned within an interior cavity 58 defined by housing body 50, as depicted in FIG. 5. However, as viewed from the exterior of housing body 50, internal ridge 52 may appear as an external channel defined in the underside surface of housing body 50. Internal ridge 52, or external channel, depending on the point of view, may be configured to dimensionally correspond to the width W and depth D of base member 30. Indeed, internal ridge 52 may be configured to functionally engage base member 30 and physically couple thereto, such that housing 40 and base member 30 may be releasably and repeatedly coupled to one another. Housing body 50 may be positioned over base member 30, such that internal ridge 52 is positioned proximate base member 30. Once in positional alignment, housing body 50 may be lowered onto base member 30 until internal ridge 52, or external channel, covers base member 30, such that internal ridge 52 functionally and structurally engages base member 30, as depicted in FIG. 5. Once engaged, base member 30 and internal ridge 52 may be coupled together by fastening members, such as screws, bolts, mechanical clasps, friction fit, and/or the like.

Figure 6:
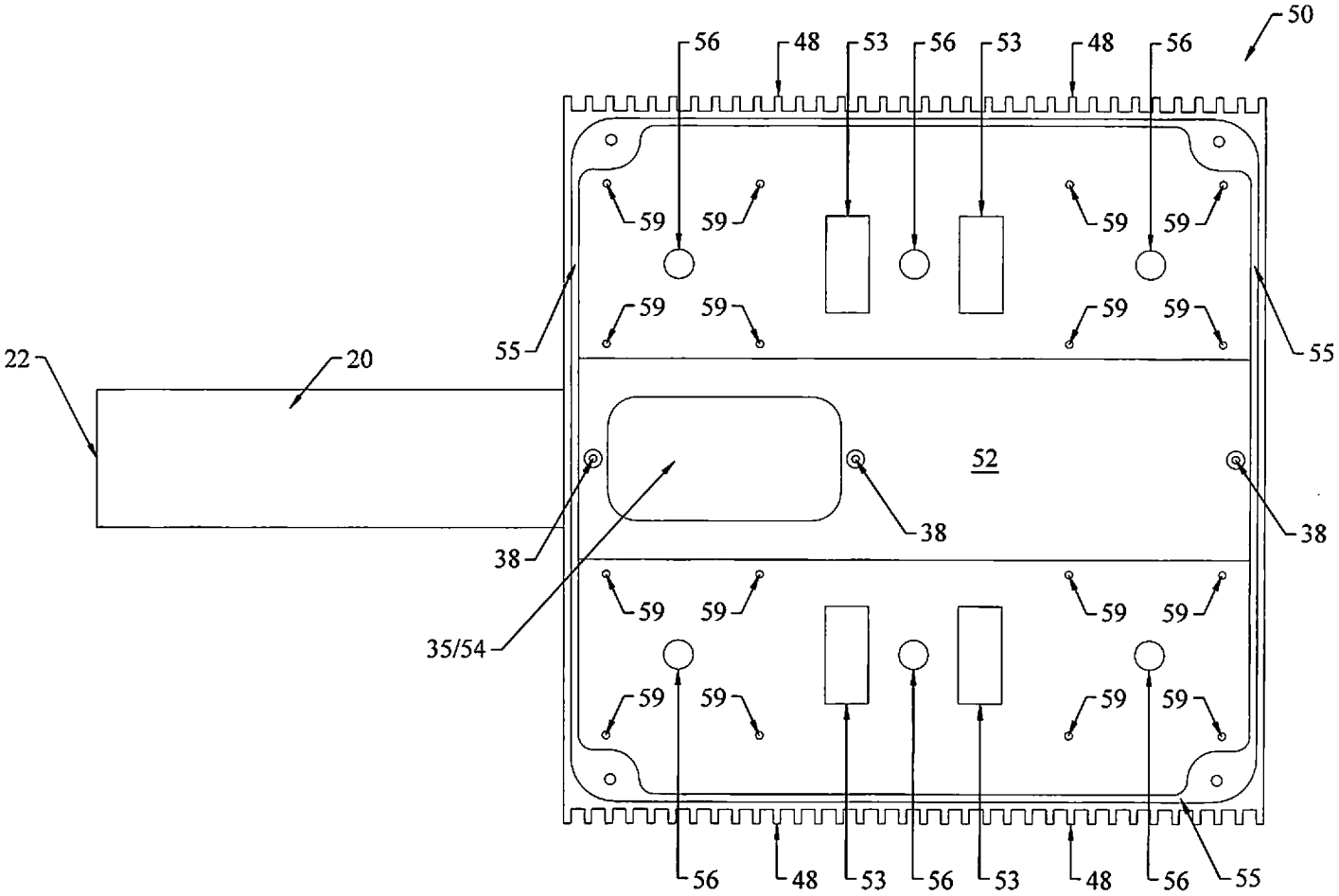
FIG. 6 is a top view of components of an embodiment of an intermediate device structure/system in accordance with the present disclosure.

With reference to FIG. 5, embodiments of IDS 10 may further comprise internal ridge 52 defining one or more internal cavities 58 within housing 40, the one or more cavities 58 being positioned on either side of internal ridge 52. Internal cavities 58 may each be configured to house, support, retain, accommodate, contain, or otherwise hold various electrical components that may provide, for example, power transmission and supply, processing capability, and data connectivity and transmission between devices configured on IDS 10, between neighboring IDSs 10 or other external devices located remotely from IDS 10. Internal ridge 52 may further define an opening 54 in a surface thereof, opening 54 being configured in internal ridge 52 to correspond to and communicate with opening 35 in base member 30. In this way, cavities 58 can be placed in communication with through bores 26 and 36, which benefit will be discussed herein. Housing body 50 may further include access ports 56 for wired power and data access into and out of the interior of housing 40. Access ports 56 may be positioned in side surfaces of housing body 50, as depicted in FIG. 5, and may additionally be positioned in bottom surfaces of housing body 50, as depicted in FIG. 6. Housing body 50 may further comprise coupling ports 59 in bottom surfaces of housing body 50 to facilitate coupling of various electronic accessories to preconfigured receptacles located on the underside surface of housing body 50 and thus to housing 40. Embodiments of IDS 10 may further comprise each preconfigured receptacle having a dedicated access port 56 so that every device coupled to housing 40 at the receptacle may be electrically coupled to housing 40 for power and data connectivity.

Figure 7:
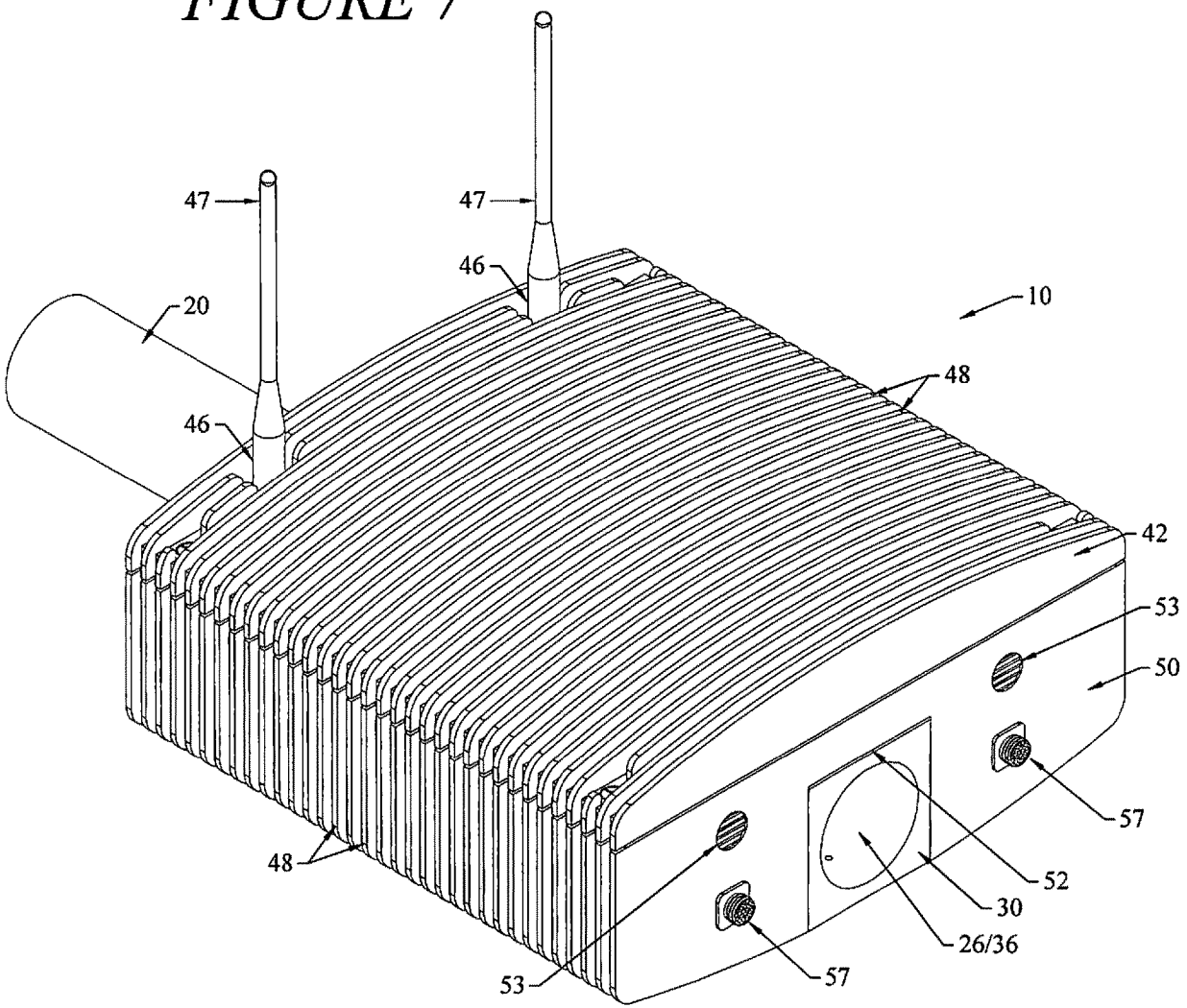
FIG. 7 is a top perspective view of components of an embodiment of an intermediate device structure/system in accordance with the present disclosure.
Figure 8:
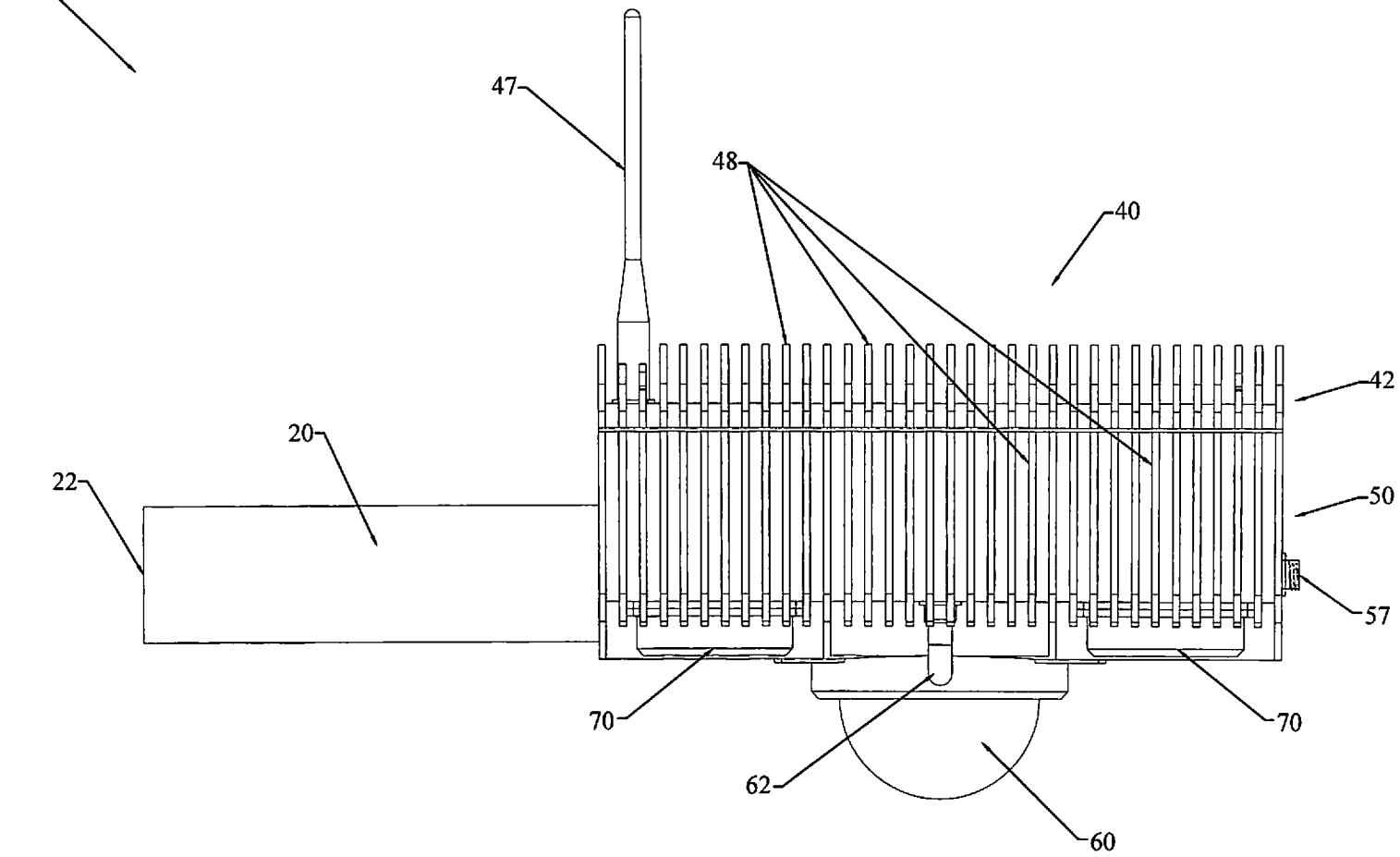
FIG. 8 is a side view of components of an embodiment of an intermediate device structure/system in accordance with the present disclosure.
Figure 9:
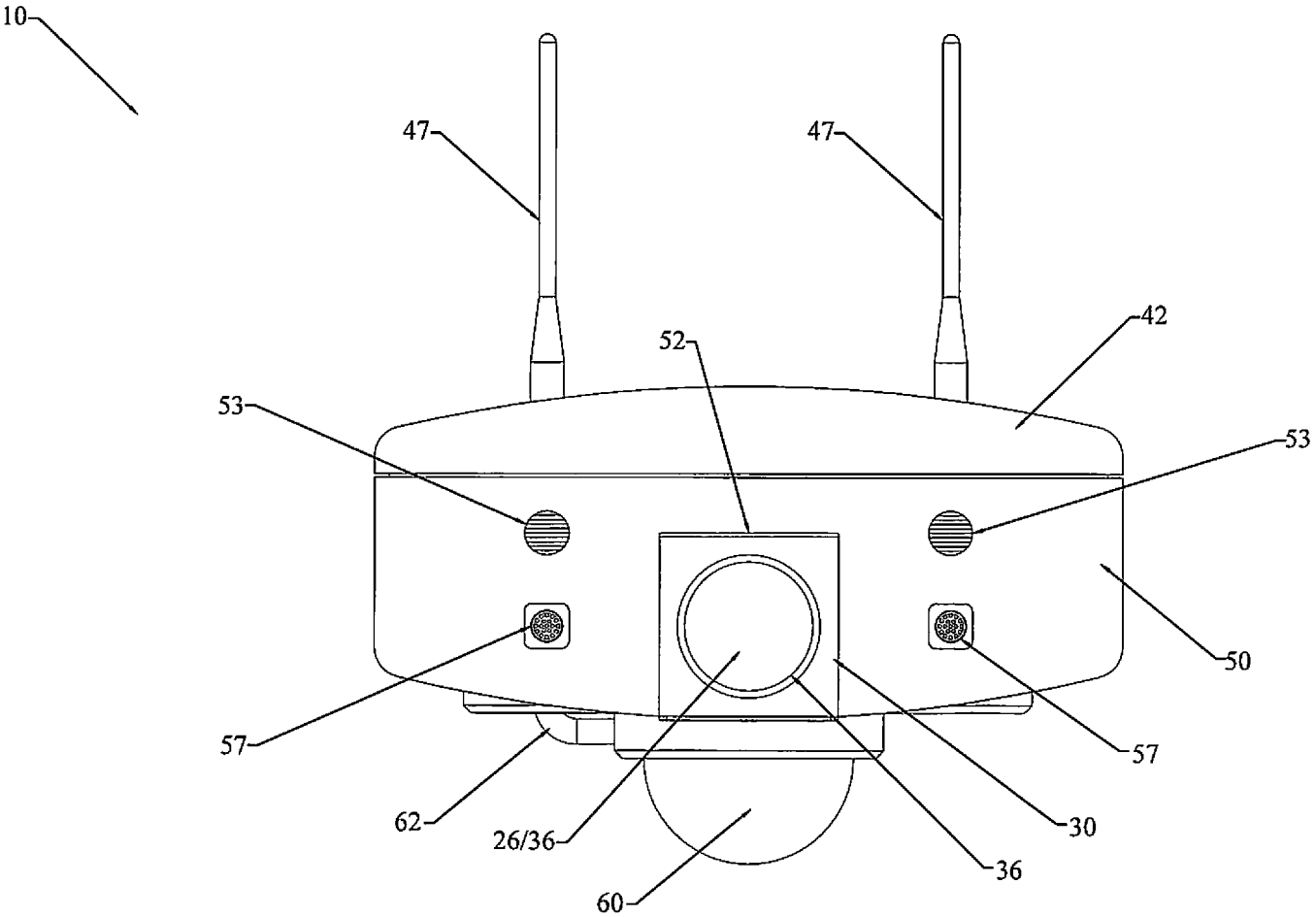
FIG. 9 is a rear view of components of an embodiment of an intermediate device structure/system in accordance with the present disclosure.

With reference to FIGS. 7-9, embodiments of IDS 10 may further comprise housing 40 including one or more preconfigured power and/or data connectivity docks 57 inserted into ports 46/56. Docks 57 may facilitate a quick-connect capability of various devices onto housing 40 to become part and portion of IDS 10. Docks 57 may be configured to allow various auxiliary devices to quickly and efficiently establish power and data connectivity to IDS 10. Embodiments of IDS 10 may further comprise one or more antennas 47 coupled to housing 40 on housing cover 42 or housing body 50. As depicted, antenna 47 may be configured to couple to housing cover 42 at port 46. In this way, antenna 47 may extend outwardly from and above housing 40 to efficiently transmit and receive radio waves for communication with other electronic devices as directed according to the particular configuration of IDS 10. Embodiments of IDS 10 may further comprise one or more vents 53. Vents 53 may be configured to permit the flow of air into and out of housing 40. Vents 53 may be configured to provide moisture/dust-free air flow in an out of housing 40.

Embodiments of IDS 10 may further comprise a mechanical eye 60, such as a camera or other optical instrument. Mechanical eye 60 may be any auxiliary device that may be functionally coupled to IDS 10 to provide optical image input to IDS 10 and other auxiliary devices coupled thereto. Mechanical eye 60 may be configured to be physically coupled to housing 40 at a lower region of housing 40 or on a bottom surface of housing 40. As depicted, mechanical eye 60 may be configured to be physically coupled to base member 30 on a bottom surface of base member 30. Mechanical eye 60 may be configured to be releasably and repeatedly coupled to housing 40, as needed. Mechanical eye 60 may be configured to couple to dock 57 to facilitate quick and easy connection to power and data connectivity provided through IDS 10.

Figure 10:
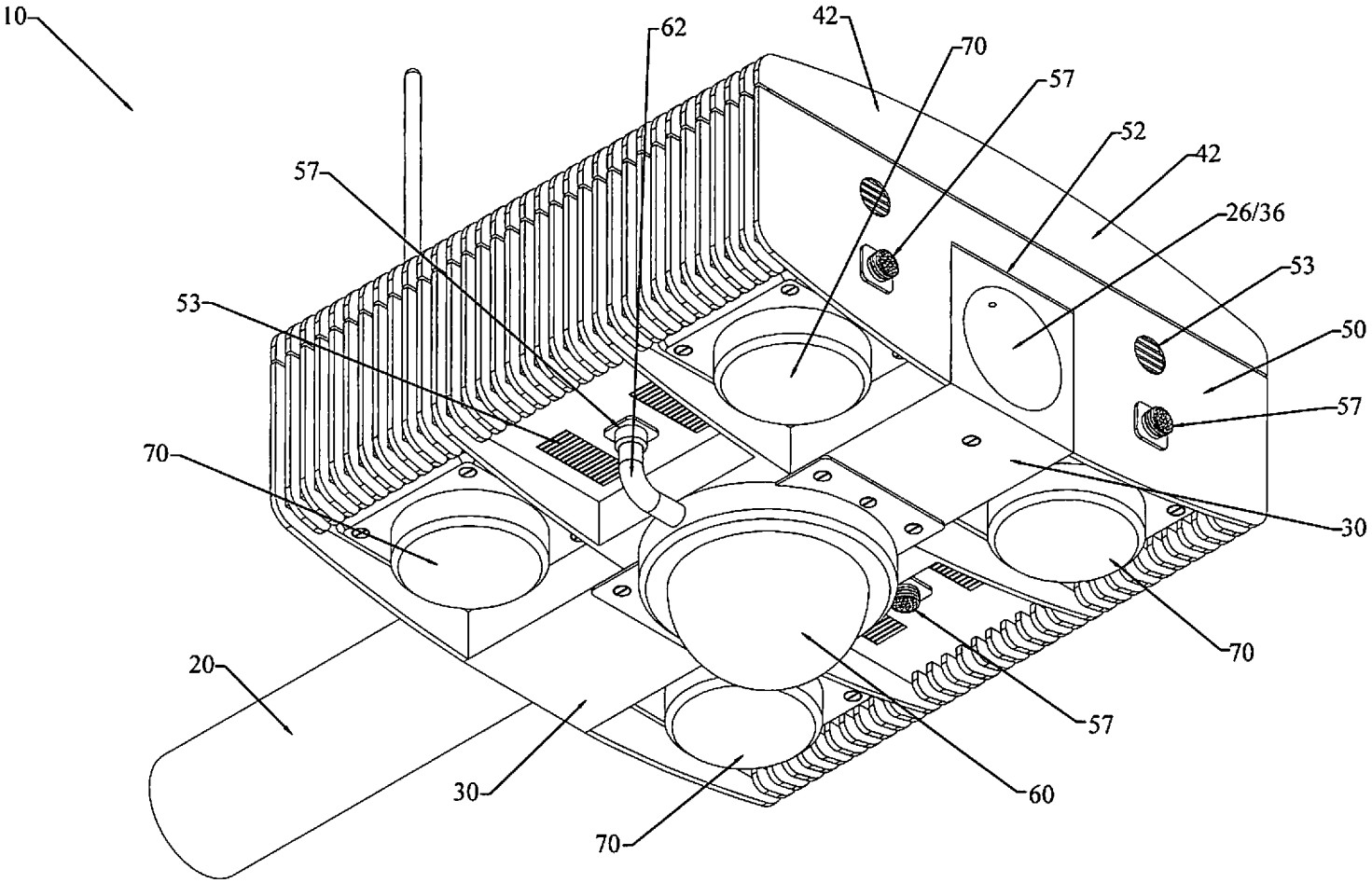
FIG. 10 is a bottom perspective view of components of an embodiment of an intermediate device structure/system in accordance with the present disclosure.
Figure 11:
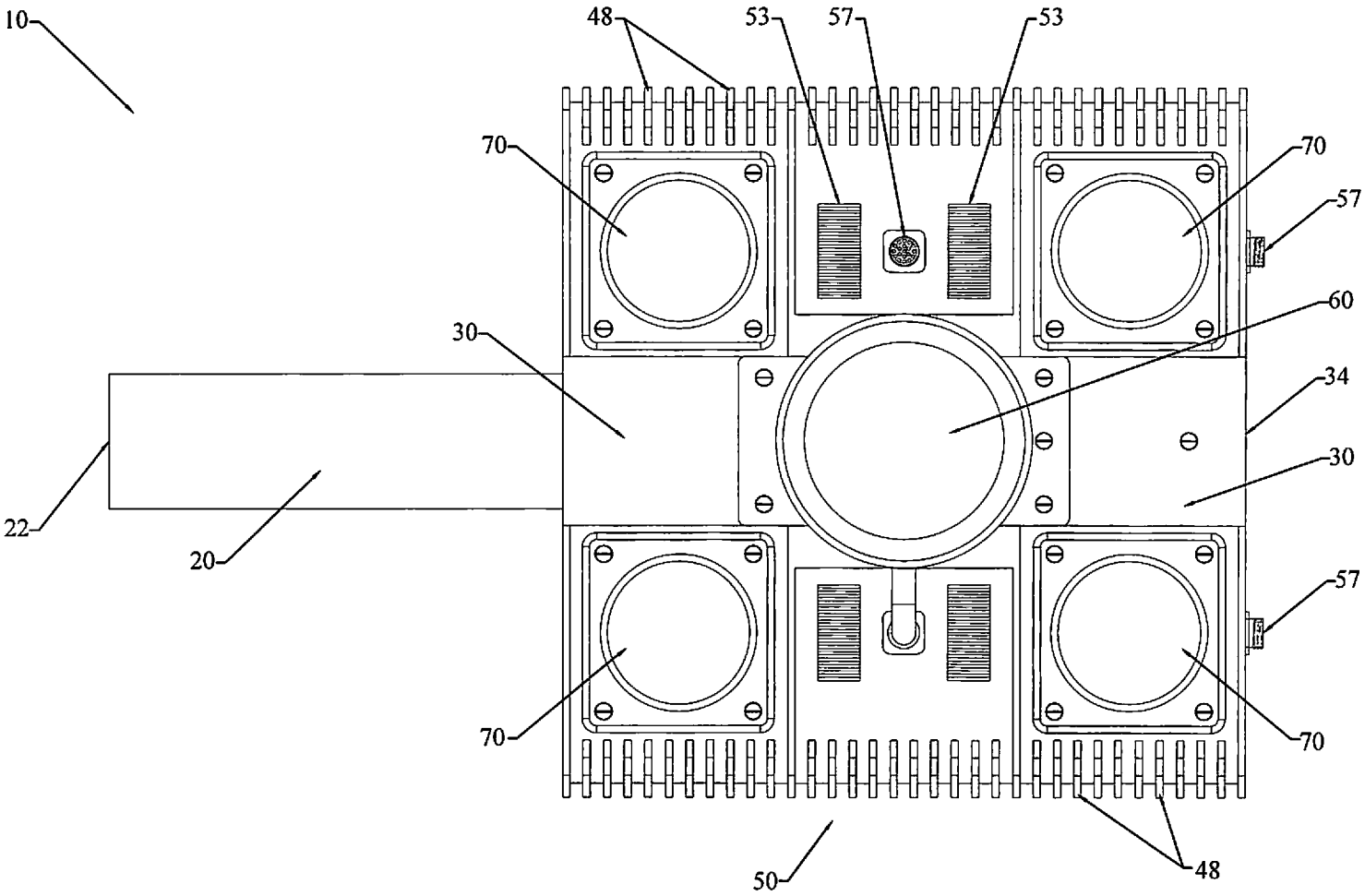
FIG. 11 is a bottom view of components of an embodiment of an intermediate device structure/system in accordance with the present disclosure.

With reference to FIGS. 10 and 11, embodiments of IDS 10 may further comprise one or more auxiliary devices 70. Auxiliary devices 70 may be configured to be physically coupled to housing 40 at a lower region of housing 40 or on a bottom surface of housing 40. Auxiliary devices 70 may also be configured to be releasably and repeatedly coupled to housing 40, as needed. Auxiliary devices 70 may be configured to functionally couple to the lower exterior surface of housing 40 over a port 46. Port 46 may comprise a dock 57 to facilitate quick and easy connection of each auxiliary device 70 to power and data connectivity provided through IDS 10. Alternatively, port 46 may comprise simply an opening through which electrical and data transmission wiring may be passed to facilitate wired connection between auxiliary device 70 and IDS 10 to establish power and data connectivity to the auxiliary device 70 provided through IDS 10. In this way, each auxiliary device 70 may be powered along with IDS 10 and may exchange data therewith and/or with other remotely located electronic devices.

Figure 12:
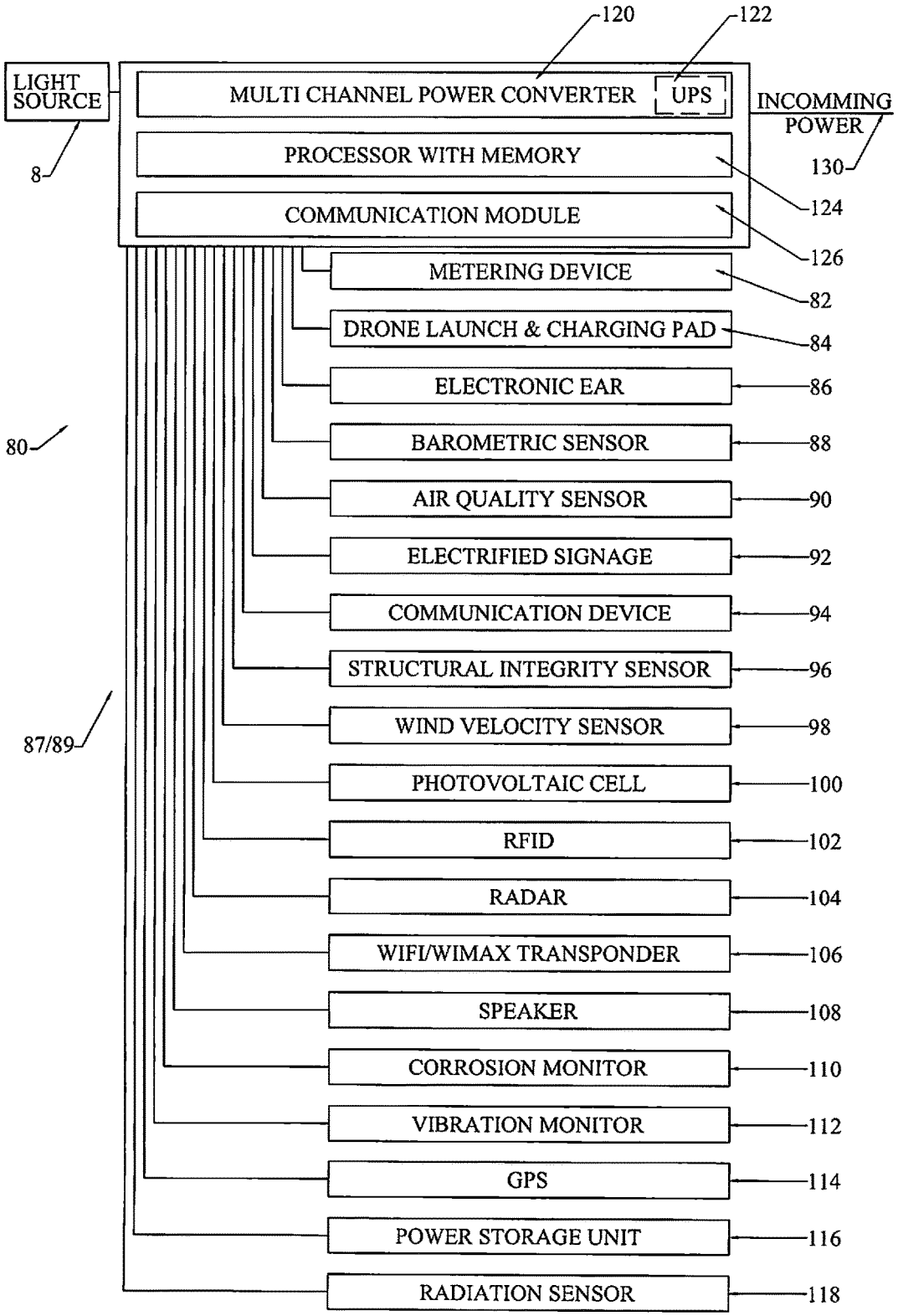
FIG. 12 is a schematic view of components of an embodiment of an intermediate device structure/system in accordance with the present disclosure.

With reference to FIG. 12, embodiments of IDS 10 may further comprise a control unit 80. In general, control unit 80 may comprise sufficient processing power coupled with sensor perception in order to allow IDS 10 to emulate the human capacity of making actionable, predictable, and accurate decisions in response to sensed environmental input and/or changes. For this purpose, control unit 80 may therefore be configured to be capable of accepting and operating a variety of auxiliary devices 70 independently or in unison, each auxiliary device 70 being configured to sense a parameter of the surrounding environment. For example, mechanical eye 60 may be considered one of several auxiliary devices 70 that control unit 80 can control, manipulate, operate, direct, activate, manage, run, administer, oversee, work, maneuver, or otherwise govern to the benefit of the operational functions of IDS 10 according to programmed parameters, hardware and software capabilities, and sensory input. Mechanical eye 60 may operate to effectively provide an eye into the community, and in particular to the surrounding environments around IDS 10. Mechanical eye 60 may observe, survey, study, and/or monitor surrounding environments and provide a means for remote clients, such as first responders, police, fire and rescue, EMTs, etc., to view, watch, or otherwise see the happenings and conditions around IDS 10 in real-time. Mechanical eye 60 may be configured to redirect its line-of-sight in 360 degree orientation, such that mechanical eye 60 may provide 360 degree views of the surrounding environment. Mechanical eye 60 may operate by client-directed input received remotely from IDS 10 (i.e., mechanical eye 60 can be operated by users remote from IDS 10), or mechanical eye 60 may operate automatically by pre-programmed instructions that are based on sensory input of other auxiliary devices 70.

Further in example, and not by way of limitation, auxiliary devices 70 may further comprise a metering device 82, a drone launch and charging pad 84, an electronic ear 86 (such as a microphone or other auditory instrument), a barometric sensor 88, an air quality sensor 90, electrified signage 92, a communication device 94, a structural integrity sensor 96, a wind velocity sensor 98, a photovoltaic cell 100, an RFID reader 102, radar 104, broadband communication hardware 106 (such as WIFI/WiMAX transponders, transceivers, and other communication gear; 3G and 4G communication gear), a speaker 108, a corrosion monitor 110, a vibration monitor 112 (such as a piezoelectric sensor), GPS technology 114, power storage unit 116 (such as a battery or backup power unit), and a radiation sensor 118 (such as a high-energy particle detector). RFID reader 102 may further comprise any other signal reader that is capable of reading a signal being broadcast by a corresponding tag. These auxiliary devices 70 listed herein may not be considered to be all inclusive. That is, the auxiliary devices 70 listed herein may additionally include other community system and monitoring devices and circuits not listed herein. For example, auxiliary devices 70 may further comprise seasonal lighting displays, long-term and short-term electrified signage, astronomical clock for keeping and tracking time, a thermometer of any variety for measuring one or more temperatures, one or more photocells, and one or more infrared sensors (such as motion sensors), each of these being configured to be electrically coupled to IDS 10 and configured to be controlled thereby. Control unit 80 may be housed in housing 40, such as within cavity 58. Auxiliary devices 70 may be housed in housing 40, such as in cavity 58, and may alternatively be coupled housing 40 on an exterior portion thereof, as described herein.

Embodiments of drone launch and charging pad 84 may comprise a drone being configured on IDS 10. As information from the network of IDSs 10 is relayed between IDSs 10, the IDS 10 equipped with drone launch and charging pad 84 may instruct the drone to launch and travel to a particular destination, such as a vehicle accident, vehicle emergency, high-speed chase, crowd control, community emergency, or other event, and provide aerial views in real-time. These views/images may be relayed from the drone to nearby IDS 10 or to other remote electronic devices or clients. Once finished with the assigned task, the drone may return to its IDS 10 and land to recharge its batteries on drone launch and charging pad 84. Drone launch and charging pad 84 may be configured to be charged by power being routed through one or more power supply modules and distribution networks, to be discussed herein.

Auxiliary devices 70 may be optimized to provide a broader platform for a larger number of auxiliary devices 70 with greater interactive capabilities. Thus, in a general sense, control unit 80 may be considered the heart and mind of IDS 10, the structural components, such as coupling arm 20, base member 30, and housing 40 may be considered the skeletal support of IDS 10, and auxiliary devices 70 may be considered the muscle and sensory input of IDS 10. For example, coupling arm 20, base member 30, and housing 40 may provide a physical platform in conjunction with pole 4, and in particular mast arm 6, on which IDS 10 may be positioned for optimal benefit to the community in the performance of its intended functions. Further in example, auxiliary devices 70 may gather information of the surrounding environment around IDS 10 and relay this information to control unit 80 for processing. Control unit 80 may then provide directives, instructions, or commands to IDS 10 for further sensory gathering operations, to the surrounding environment in the form of direct and immediate audible or visible alerts, or to remote devices or clients positioned at a short or great distance from IDS 10. Each IDS 10 may also form part of a larger network of IDSs 10. Taken together, the network of IDSs 10 may be configured to operate together in unison to provide a larger-scale view of conditions in a community or along a roadway in real-time. Communications hardware and wiring may comprise electrical wiring, broadband communication cable, fiber optic cable, category 5 cable, network cable, twisted pair cable, or other similar wiring and cable that is configured to carry, transmit, and otherwise support electricity, power, data exchange, and/or the like.

Control unit 80 may further comprise essential operating components within cavity 58 of housing 40 of IDS 10, the essential operating components may include one or more power supply modules 120, one or more processors 124 with associated memory 125, and one or more communication modules 126 that direct I/O operations of IDS 10. Power supply module 120 may include a power converter and distribution module. Control unit 80 may further comprise long-term data storage 128, such as a hard drive, solid state drive, or other data storage device. Each of the individual components of control unit 80, including for example, power supply module 120, processor 124, RAM memory 125, communication module 126, data storage 128, and auxiliary devices 80, may each be suitably connected via a power bus 87 and a data bus 89 (represented as solid lines). Control unit 80 and its associated component parts and wiring may be referred to as an electronic assembly.

Embodiments of IDS 10 may comprise power supply 120 being a power supply and distribution module. As such, power supply 120 may be configured to receive line power 130 via wiring 5 from the existing power grid of the municipality. Wiring 5 may run from the ground and up through pole 4, through mast arm 6, and into cavity 58 of housing 40 by way of openings 35/54 in base member 30 and internal ridge 52, respectively. In this way, line power 130 may arrive at power supply 120 and may be electrically coupled to power supply 120. As a power converter and distribution module, power supply 120 may be configured to take the received line power 130 and convert line power 130 into various degrees of low-voltage power needed to operate any one or more of the various auxiliary devices 70, as needed and required by each device 70. Power supply 120 may be configured to systematically and automatically recognize auxiliary devices 70 coupled to IDS 10 and determine the power requirements of each device 70 and may thereafter convert line power 130 into the specific power required by device 70 and then distribute or route this converted power to device 70. In the alternative, the specific power requirements of each device 70 may be input into IDS 10 via programming and updating control code 81 to do so. Yet, regardless of how IDS 10, control unit 80, processor 124, or control code 81 determines what power to send to each individual device 70, power supply 120, as a power converter and distribution module, may be configured to perform this line power reception, low-voltage conversion, and distribution for each auxiliary device 70 coupled to IDS 10, whether device 70 is positioned within housing 40 or external to housing 40. In like manner, luminaire 8 may be electrically coupled to power supply 120. As such, IDS 10 may be configured to control, convert, and distribute electric power to luminaire 8 according to the functions of IDS 10 described herein. In other words, as a power converter and distribution module, power supply 120, may be configured to perform this line power reception, low-voltage conversion, and distribution for the luminaire 8 in addition to each of the devices 70. This feature provides that IDS 10 may be configured to take an existing source of line power 130 and convert this electric power to the individual power requirement needs of any and all electronic devices coupled to or related to the operations of IDS 10 and distributes this converted/required power according to the operational directives of IDS 10 as determined by sensory input from devices 70 or programmed directives of IDS 10. This feature allows IDS 10 to be retrofitted on existing poles 2 and with a single electrical connection to line power 130 become a facilitator of smart technology, with each IDS 10 being customizable with devices 70 to the needs of communities, municipalities, and citizenry as determined on a case-by-case basis or a pole-by-pole basis.

In the alternative, as a power converter and distributor, power supply 120 may be configured to convert line power 130 to the low-voltage power needed to operate the various devices 70 of IDS 10 and control unit 80, as described above, but may leave untouched the electrical connections of luminaire 8. Thus, despite IDS 10 being coupled to line power 130 through power supply 120, luminaire 8 may be directly coupled to line power 130 as it was prior to installation of IDS 10. Or, through software and/or control code 81, IDS 10 may be configured to control some portion of the functions of luminaire 8 while luminaire 8 continues to receive its power from line power 130.

Power supply 120 may be modular and scalable having one or more input power channels 121 and output power channels 123. Input and output power channels 121, 123 may be programmable with flexibility to change the power supplied and device specific power operational parameters as needed. Power supply 120 may have an optional dedicated processor 127, governing the power from power supply 120 while maintaining real-time communication with processor 124 of control unit 80. In some embodiments, power supply 120 may also have direct communication capability with an external network (not shown). Power supply 120 may also be configured to receive and utilize photovoltaic power, such as from photovoltaic cell 100.

Embodiments of IDS 10 may further comprise a backup emergency battery, e.g., UPS 122, whose power may be selectively distributed to all essential services and devices during an emergency. UPS 122 may be also connected to photovoltaic cell 100 to receive power therefrom. UPS 122 may be networked with other input/output onboard environmental data collection, assessment, and operational devices, and have remote communication capability.

Embodiments of IDS 10 may further comprise low-voltage auxiliary devices 70 being housed within housing 40, on exterior surfaces of housing 40, on pole 4, in communication with pole 4 but below the ground surface (i.e., below grade), and in and on pole 4 in various locations, as desired and determined by intended use and configuration of IDS 10. As suggested above, luminaire 8 may be configured to operate on power and controls that have limited connectivity to IDS 10, wherein housing 40 of IDS 10 is merely a pass through for luminaire 8 power and control. On the other hand, luminaire 8 may be configured to operate on power and controls that is directly connected to IDS 10 and controlled by IDS 10 operations, wherein IDS 10 governs operations and control of luminaire 8 and luminaire 8 is comprised merely of lamps and optical encasements. In other words, while luminaire 8 may contain hardware for dispensing light in low-light settings, control and operational aspects of luminaire 8 may be controlled and governed by IDS 10, such as hours of operation and illumination intensity just to name a few.

Data output from power supply 120 may include reporting on the quality of the input power from wiring 5 and/or input power channels 121, the operational temperature of power supply 120, the power consumption of power supply 120 including client devices such as communication module 126, processor 124, and auxiliary devices 70, time of usage broken down by device, and operational anomalies. Power supply 120 may process the highest electrical load of control unit 180 and may therefore be located proximate the interior surface 44 of housing cover 42 to exchange heat therewith to effectively cool power supply 120. Circuit boards (not shown) for power supply 120 may be wired by a conventional method or engaged by plug-in connectors. Additionally, the circuit boards may be encased or open and may be secured within cavity 58.

Embodiments of IDS 10 may further comprise control unit 80 including control code 81 that may be multi-device relational software designed to operate, control, and otherwise govern auxiliary devices 70 independently or in unison. In addition, processor 124 may be configured to execute control code 81 and thereby receive local device sensory input from one or more auxiliary devices 70 and then compile this information in accordance with pre-programmed instructions. Processed information may then be converted to actionable output to auxiliary devices 70. In addition, processor 124 may be configured to communicate with neighboring IDSs 10 or with other devices remotely located from IDS 10. Processor 124 may direct the communication of sensed information or pre-programmed instructions and/or directives based on sensed information to remote devices or remote clients, such as first responders, police departments, fire and rescue teams, etc.

Embodiments of IDS 10 may further comprise processor 124 containing resident memory 125 that may be programmed with control code 81 prior to installation in IDS 10 or on mast arm 6, during operational use, or at any time thereafter. For example, programming may be performed by a wired connection to a port, e.g., data line dock 57 connected to port 46 or wirelessly via antenna 47. Likewise, updates to IDS 10 in general, to control code 81, to operational instructions, or to device specific updates may occasionally be performed with occasional device upgrades. Indeed, because housing body 50 is configured with one or more receptacles on its bottom exterior surface, devices 70 may be updated, exchanged, interchanged, or replaced as needed according to device life expectancy, device configuration, or desired capabilities of IDS 10 for the particular location within the municipality. Embodiments of IDS 10 may further comprise docks 57 and any other similar input ports to IDS 10 being keyed to accept only approved network devices. With docks 57 being keyed to accept only authorized auxiliary devices 70, only those clients, customers, manufacturers that have been approved for working with IDS 10 may be permitted to couple their respective devices 70 thereto. Such keys may be digital access codes or may be programmed into IDS 10 control code 81 or into the software of individual auxiliary devices 70. In the alternative, such keys may be specifically required hardware (i.e., protectable shaped and sized connectors) for use in electrically coupling to IDS 10.

An advantageous feature of IDS 10 may include the capability to easily and efficiently change out, replace, repair, exchange, or interchange component parts, including auxiliary devices 70. One IDS 10 may include some or all of auxiliary devices 70, whereas another IDS 10 may not include some or all of auxiliary devices 70. Many auxiliary devices 70 may be coupled to the underside surfaces of housing 40, whereas other primary components, such as power supply 120, processor 124, and communication module 126 may be accessed simply by removing housing cover 42 from housing body 50. And, because some or all of these devices are equipped with quick connect configurations, each of these devices may be easily removed, installed, or replaced, as needed.

Embodiments of IDS 10 may further comprise control code 81 being scalable by modules, where each module relates to the functionality of an associated device and its relation to other onboard devices and the entire network's devices. Control code 81 may be provided with input tables such as schedules and set points, as well as alert parameters and operational reports. In addition, control code 81 can be customized for specific applications and may include self-learning modules. Processor 124 may have sufficient memory 125 associated therewith to access and act on pertinent information in real time. Additionally, control code 81 may be provided with a self-reporting module associated with each auxiliary device 70 to report the device's operational condition and provide alerts when the device 70 performs outside its optimal performance range.

Embodiments of IDS 10 may further comprise each IDS 10 being assigned a unique address that is associated with the identification information of the pole 2 to which IDS 10 is connected. For example, each pole 2 or IDS 10 may be assigned a unique alphanumeric ID, or the pole 2 may be identified by its location according to GPS coordinates. Based on this unique ID, IDS 10 may be capable of assigning a sub-address to all devices 70 coupled or functionally connected to IDS 10. In this manner, the operational integrity of the various elements of auxiliary devices 70 may be monitored and any anomalies with onboard devices may be alerted, identifying the nature of the anomaly and possible recommendations for action. Information specific to each auxiliary device 70 may be recorded and stored for retrieval upon status inquiry. Information may include device manufacturer, device serial number, date of installation, license renewal alerts, warranty control, device reliability and life expectancy, event records, and maintenance schedules. Moreover, under the condition that an IDS 10 senses an environmental input that triggers a local and/or remote client response, the unique address of the IDS 10 may be communicated to the client(s) to allow the client(s) to arrive at the correct destination to address and/or resolve the situation or problem.

Embodiments of IDS 10 may further comprise IDS 10 functioning as a local environment area manager. For example, control unit 80 and control code 81 may work hand-in-hand to facilitate direct, or via processor 124, communication with onboard auxiliary devices 80. Additionally, communication module 126 may be configured to facilitate communication between onboard auxiliary devices 80, as well as between a plurality of IDSs 10, as well as between local and remote municipality management systems, as well as between local and remote clients, such as first responders, police, fire and rescue, EMTs, and others that may need real-time input about a specific location in a part of the community. Communication module 126 may employ radio frequency (RF) communication via antenna 47 to facilitate remote communication with other electronic devices and systems. For example, electronic ear 86 may pick up an auditory input or signal from the surrounding environment that is consistent with a preprogrammed auditory input that triggers further action from IDS 10, such auditory input being, for example, the sound of a vehicle collision on or near the roadway. IDS 10, in response to the auditory input and preprogrammed instructions associated therewith, may activate mechanical eye 60 to provide a real-time view of the scene. Moreover, IDS 10, in response to the auditory input and preprogrammed instructions, may communicate with remote clients to direct first responders to the scene and may communicate with neighboring IDSs 10 and possibly traffic lights to regulate and direct traffic flow away from or around the scene, as needed. Such capability of IDS 10 to respond to environmental input and perform necessary operations, such as directing IDS 10 operations and communicating with remote clients and devices, may be especially important if the vehicle occupant is disabled by the vehicle collision and cannot perform these functions himself/herself.

IDS 10 may be programmed in similar fashion to respond accordingly to any number of environmental conditions measurable by any of auxiliary devices 70 on IDS 10. As such, auxiliary devices 70 may be utilized in connection with lighting control, traffic control, life safety, loss prevention, asset management functions, and/or operational optimization.

Lighting control may entail IDS 10 being configured to govern time of use or lighting intensity of luminaire 8. Lighting control may also entail one or more IDSs 10 cooperating with one another to turn on or off or dim as vehicle or pedestrian traffic passes thereunder or thereby. IDS 10 may be programmed to turn luminaire 8 off if IDS 10 does not sense movement thereunder, thus preserving energy consumption and prolonging life expectancy of luminaire 8.

Traffic control may entail IDS 10 being configured to provide local and remote monitoring of traffic patterns, traffic backups, traffic accidents, and roadway obstructions. Traffic control may entail IDS 10 being configured to govern traffic light operations and recommend alternative traffic routes based upon traffic flow and accident reports discovered by one or more IDSs 10 in the community and along roadways. Traffic control may entail IDS 10 being configured to govern traffic light operations to allow first responders to arrive at the scene of an accident or emergency in as little time as possible. Traffic control may entail IDS 10 being configured to govern traffic light operations to allow funeral processions to proceed along roadways with as little interference or traffic flow disruption as possible. Traffic control may entail IDS 10 being configured to monitor crowd control at large public events, such as concerts, swap meets, sporting events, and the like. Audible and/or visible commands may be given by IDS 10 to local and remote devices/client in response to sensed input of crowd density, crowd noise, crowd movement, and the like.

Life safety may entail IDS 10 being configured to provide local and remote monitoring of air quality, including discovering airborne contaminants and threats. As one IDS 10 senses an airborne contaminant, the one IDS 10 may relay this information to neighboring IDSs 10 and other remote devices. As such, the network of IDSs 10 may coordinate information and communicate with one another to provide a "safety net" of helpful information over communities and roadways. Life safety may entail IDS 10 being configured to audibly and/or visibly warn surrounding communities and vehicle and pedestrian traffic on roadways of impending danger up along the roadway or approaching danger from behind on the roadway, such as a high-speed chase. Life safety may entail IDS 10 being configured to provide local and remote monitoring of weather patterns and temperature patterns, such as deep freezes, humid conditions, extreme heat, or high winds. Audible and/or visible commands may be given by IDS 10 to local and remote devices/client in response to sensed input of weather conditions, temperature, and the like. Life safety may entail IDS 10 being configured to analyze traffic patterns and traffic flow in and around traffic accidents, traffic emergencies, or other localized non-traffic emergencies, such as fires and the like, to reroute traffic to prioritize optimal routes for first responders. IDS 10 may be configured to locate first responders and, based on their respective positions, anticipate quickest routes by calculating time from current location to arrival on scene, and configure traffic patterns and traffic flow to permit first responders to arrive on scene in as little time as possible. IDS 10 may be configured to divert non-essential traffic to a different route to optimize first responder response.

Loss prevention may entail IDS 10 being configured to monitor public environments for suspicious activity of local and remote clients to prevent theft, crime, or disorderly conduct, or the like via sensory input from auxiliary devices 70 and behavioral software analysis of sensed input. Loss prevention may entail one or more IDSs 10 being configured to monitor location of stolen vehicles or vehicles identified in an AMBER alert operation. One or more IDSs 10 may be configured to have a mechanical eye 60 that may be configured to read vehicle license plate numbers and/or faces and features of pedestrians that pass thereby. Control unit 80 may thereafter process this visual information and communicate the identification and location of the identified vehicle or person in question once discovered. Loss prevention may entail IDS 10 being configured to sound an audible and/or visual alarm for sensed abnormalities, such as unauthorized entry into a vehicle where IDS 10 has been informed the vehicle is not to be entered or unauthorized removal of a vehicle from a parking stall where IDS 10 has been informed the vehicle is not to be moved.

Asset management may entail IDS 10 being configured to visually monitor roadway conditions and markings, such as the presence of potholes in the roadway or the deterioration of paint stripes and pedestrian walkways. Asset management may entail IDS 10 being configured to visually monitor ease of vehicle and pedestrian traffic flow to determine if redesign of roadways or walkways or space reallocation is needed.

Operational optimization may entail IDS 10 being configured to monitor energy being used thereby, to monitor and track maintenance history, to record events and keep an event history, and perform device and system performance evaluations, and so forth.

Figure 13:
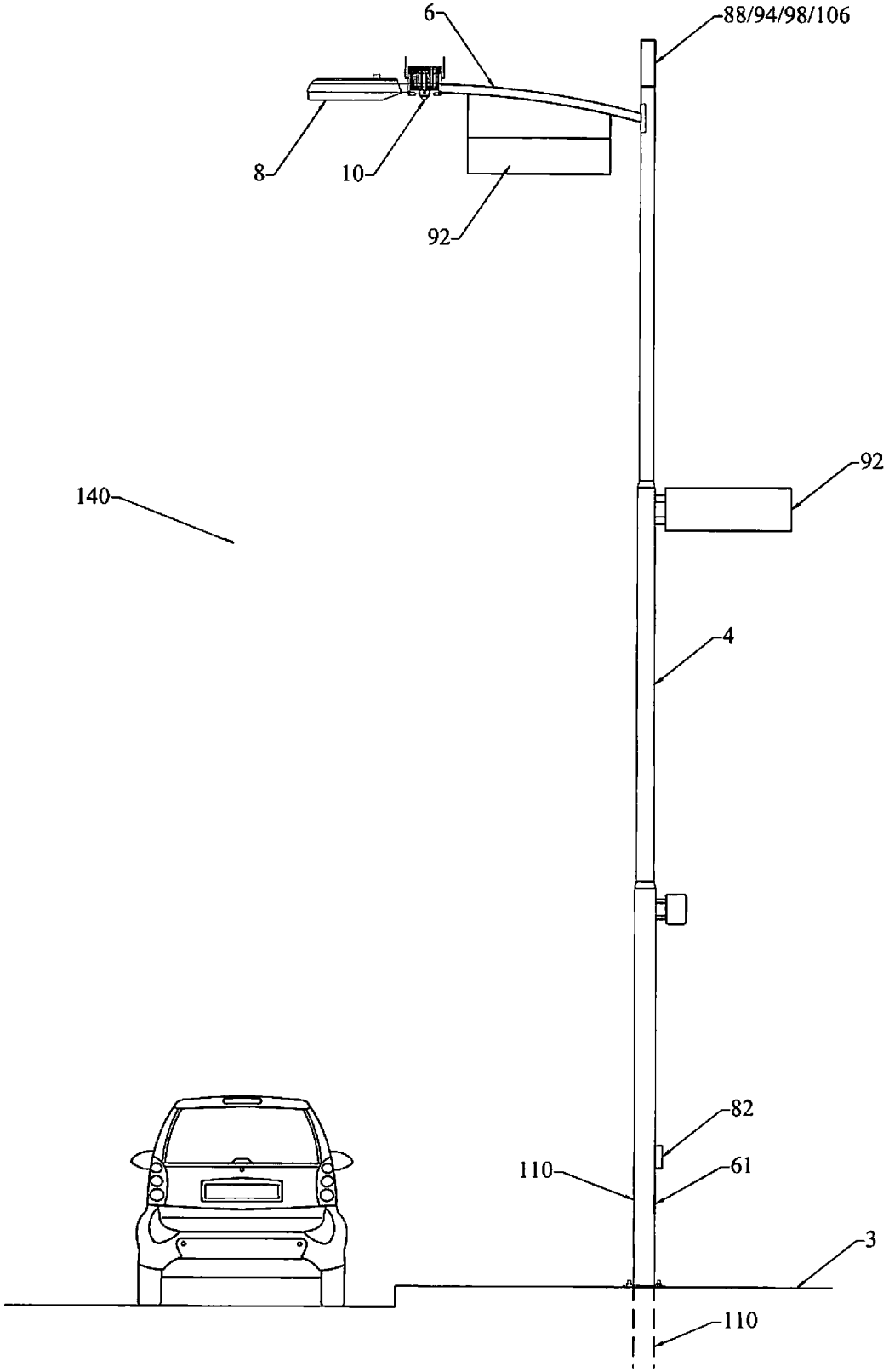
FIG. 13 is a side view of an embodiment of an intermediate device structure/system in accordance with the present disclosure.

With reference to FIG. 13, implementation of IDS 10, and its component parts and associated function as described herein, on a conventional illumination pole 2 coverts illumination pole 2 into a "smart pole" 140. Smart pole 140 may include IDS 10 being physically coupled to pole 140 in between conventional luminaire 8 and conventional mast arm 6, as described in greater detail previously. As mentioned previously with respect to component features of IDS 10, these components may be positioned remotely from housing 40 of IDS 10, but may nevertheless be positioned on, near, or around smart pole 140 to form part and portion of IDS 10, which makes smart pole 140 "smart." Smart pole 140 may further comprise electrified signage 92 at one or more positions on mast arm 6 or pole 4. Smart pole 140 may further comprise, at a top portion thereof, communication device 94, wind velocity sensor 98, barometric sensor 88, and/or transceivers for wireless communication of all types and varieties. Smart pole 140 may further comprise metering device 82 to meter how much power is consumed by each component device in operation by IDS 10. Metering device 82 may also be a user interface for operating features of IDS 10, as will be described in greater detail herein. Smart pole 140 may further comprise vibration monitor 112 for monitoring vibrations in and around smart pole 140. Abnormal vibration patterns or vibrations outside normal operating conditions may be relayed to IDS 10 and IDS 10 may communicate this information to remote clients. Smart pole 140 may further comprise structural integrity sensor 110 that may be configured to monitor soil conditions or foundation conditions below smart pole 140. Abnormal structural integrity that falls outside normal operating conditions may be relayed to IDS 10 and IDS 10 may communicate this information to remote clients. Smart pole 140 may further comprise one or more infrared sensors 61 (such as a motion sensor) for sensing the presence or absence of pedestrian traffic at crosswalks or other pathways. Indeed, infrared sensor 61 may be configured to automate crosswalk indicators on traffic lights and traffic lights themselves. For example, under the condition infrared sensor 61 senses the presence of a pedestrian on the corner of an intersection, senses that the pedestrian has lingered on the corner for an amount of time longer than a predetermined amount of time, and judges which direction the pedestrian intends to cross the street, infrared sensor 61 may communicate with control unit 80 and processor 122. Control unit 80 and processor 122 may direct IDS 10 to communicate with crosswalk lights and traffic lights to change color to stop traffic, flash a walking sign to the pedestrian, and allow the pedestrian to cross the street. All this may be accomplished without the pedestrian having to physically push a button to activate crosswalk or traffic light features.

Smart pole 140 may provide the advantageous and benefits previously described herein to communities, municipalities, and citizenry alike. Some of those advantages and benefits include the following, in addition to or complimentary to that described previously.

A feature of IDS 10 is the capability to operate one or several onboard devices from among auxiliary devices 70, such as mechanical eye 60, backup battery 119, metering device 82, drone launch and charging pad 84, electronic ear 86 (such as a microphone or other auditory instrument), barometric sensor 88, air quality sensor 90, electrified signage 92, communication device 94, structural integrity sensor 96, wind velocity sensor 98, photovoltaic cell 100, RFID reader 102, radar 104, broadband communication hardware 106 (such as WIFI/WiMAX transponders, transceivers, and other communication gear; 3G and 4G communication gear), speaker 108, corrosion monitor 110, vibration monitor 112 (such as a piezoelectric sensor), GPS technology 114, power storage unit 116 (such as a battery or backup power unit), radiation sensor 118, seasonal lighting displays, long-term and short-term electrified signage, astronomical clock for keeping and tracking time, thermometer of any variety for measuring one or more temperatures, one or more photocells, and one or more infrared sensors (such as motion sensors) in unison, based on real-time information sensed by these devices 70 and according to processing and directives coordinated by control unit 80 and programmed instructions in control code 81.

A feature of IDS 10 is the capability to perform auto-commissioning of a network of IDSs 10. For example, as mentioned, each IDS 10 may include a discrete address, and sub-addresses for component parts, that may form part of an electronic map showing each IDS 10 by its associated discrete address and its relative location to the entire network of IDSs 10. Auto-commissioning may commence following installation and implementation of IDS 10 on pole 2 to create smart pole 140, wherein IDS 10 marks its place on the electronic map by GPS coordinates.

Figure 14:
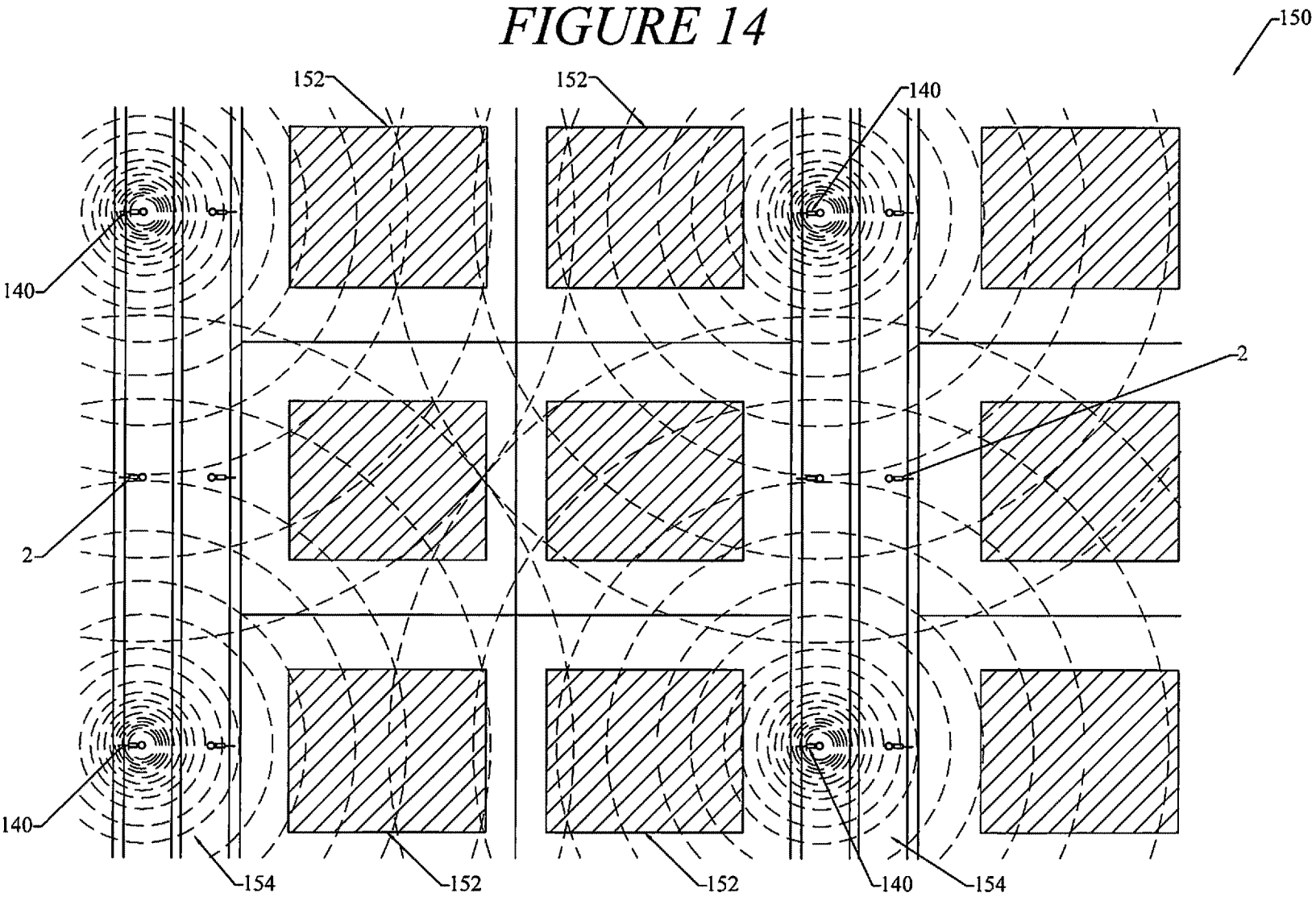
FIG. 14 is a top view of an embodiment of an intermediate device structure/system in accordance with the present disclosure.

A related feature of IDS 10 is the capability to function as part of a larger-scale mashed wireless network 150. As depicted in FIG. 14, one or more poles 4 along roadway 154 may be strategically chosen and equipped with IDS 10 having pole mounted transceivers, such as broadband communication hardware 106, to become smart pole 140 and provide citywide coverage for internet communication, as depicted by concentric dashed lines. Building structures 152, as well as public spaces there between may have access to the provided internet communication. In addition to internet communication, other communication channels may be provided separately for non-public essential and emergency services. These communication services may share the smart pole 140 real estate, having both for profit and not for profit communication. Utilizing this meshed network 150, multiple municipal functions can be executed efficiently. These functions may include monitoring, controlling, metering, and alerting, employing a minimal amount of human and material resources of the community, municipality, and/or citizenry.

A feature of IDS 10 is the capability to control light from its respective luminaire 8 at its local location. As discussed above, IDS 10 may include mechanical eye 60, communication module 126, processor 124 and/or remote processors. Processor 124 and/or the remote processors may maintain a pre-determined light level by dimming or turning luminaire 8 on or off through processing in real-time local zone illumination conditions data obtained by mechanical eye 60 and preprogrammed local or remote controller instructions. Motion detectors may also be utilized to monitor or sense movement to trigger operation of luminaire 8 by IDS 10.

Figure 15:
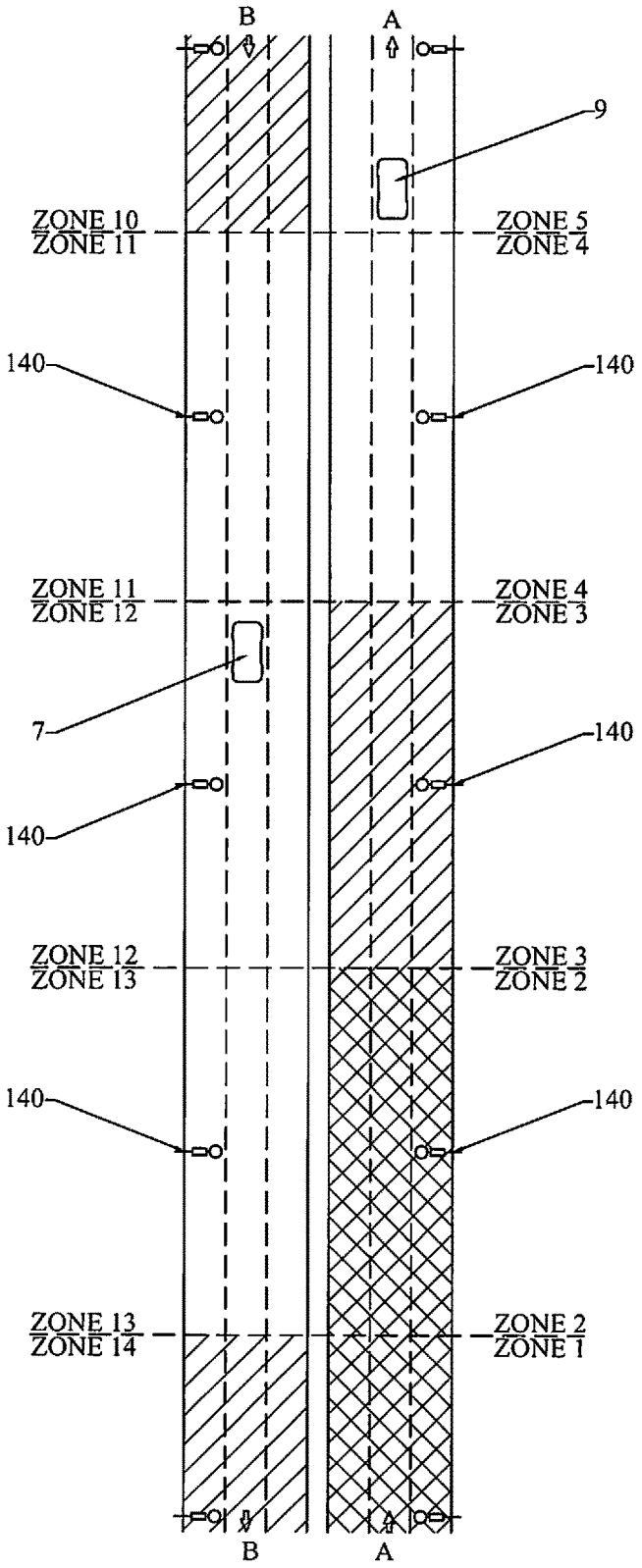
FIG. 15 is a top view of an embodiment of an intermediate device structure/system in accordance with the present disclosure.

With reference to FIG. 15, a roadway may be divided into predetermined zones, such as zones 1-10. One or more IDSs 10 may be configured to monitor traffic and pedestrian flow in each of zones 1-10 and correspondingly adjust light operation and light intensity from each corresponding luminaire 8 depending on traffic flow. Under the condition that IDS 10 does not sense any traffic movement, such as during late night/early morning hours when traffic is scarce, the respective IDS 10 may instruct its luminaire 8 to be dimmed or to turn completely off. However, under the condition when IDS 10 receives sensory input from mechanical eye 60 or other sensors, such as motion sensors, IDS 10 may instruct luminaire 8 to turn on and shine at full brightness. For example, vehicle 7 may be traveling in the direction of arrow B and vehicle 9 may be traveling in the direction of arrow A, opposite that of the direction of arrow B. IDSs 10 may sense that vehicle 7 is in zone 12. As such, IDSs 10 associated with zones 11, 12, 13 (the immediate zone in which vehicle 7 is positioned (zone 12), as well as the zone vehicle 7 just left (zone 11) and the zone vehicle 7 will enter next (zone 13)) may be lit up with 100% light output from luminaire 8. Further, IDSs 10 associated with zones 10 and 14 may be lit up with 50% (or some percentage short of 100%) light output from luminaire 8. Any zones beyond this, such as zone 9 or zone 15 may be completely dark, as IDSs 10 associated with these zones are instructing luminaires 8 to remain dark because of a lack of sensed traffic. This can be more fully understood by viewing vehicle 9 in zone 5. Zones 5 and 4 are instructed by their respective IDSs 10 to illuminate at 100%, whereas zone 3 is instructed by its respective IDSs 10 to illuminate at 50%, and whereas zones 2 and 1 are instructed by their respective IDSs 10 to illuminate at 0%. In this particular figure, crosshatching illustrates 0% illumination, hatching illustrates 50% illumination, and no hatching illustrates 100% illumination by respective luminaires 8. Each IDS 10 may communicate with neighboring IDSs 10 about current traffic flow to seamlessly transition light output from respective luminaires 8 along roadways and walkways.

A feature of IDS 10 is the capability to optimize local and entire space environmental conditions. Optimization methodology may utilize data from mechanical eye 60, motion detectors, as well as other onboard sensor devices such as processor 124, mechanical ear 86, communication module 126, and/or remote processors to process data and act in real time on changing conditions while operating within programmatic instruction guidelines.

Figure 16:
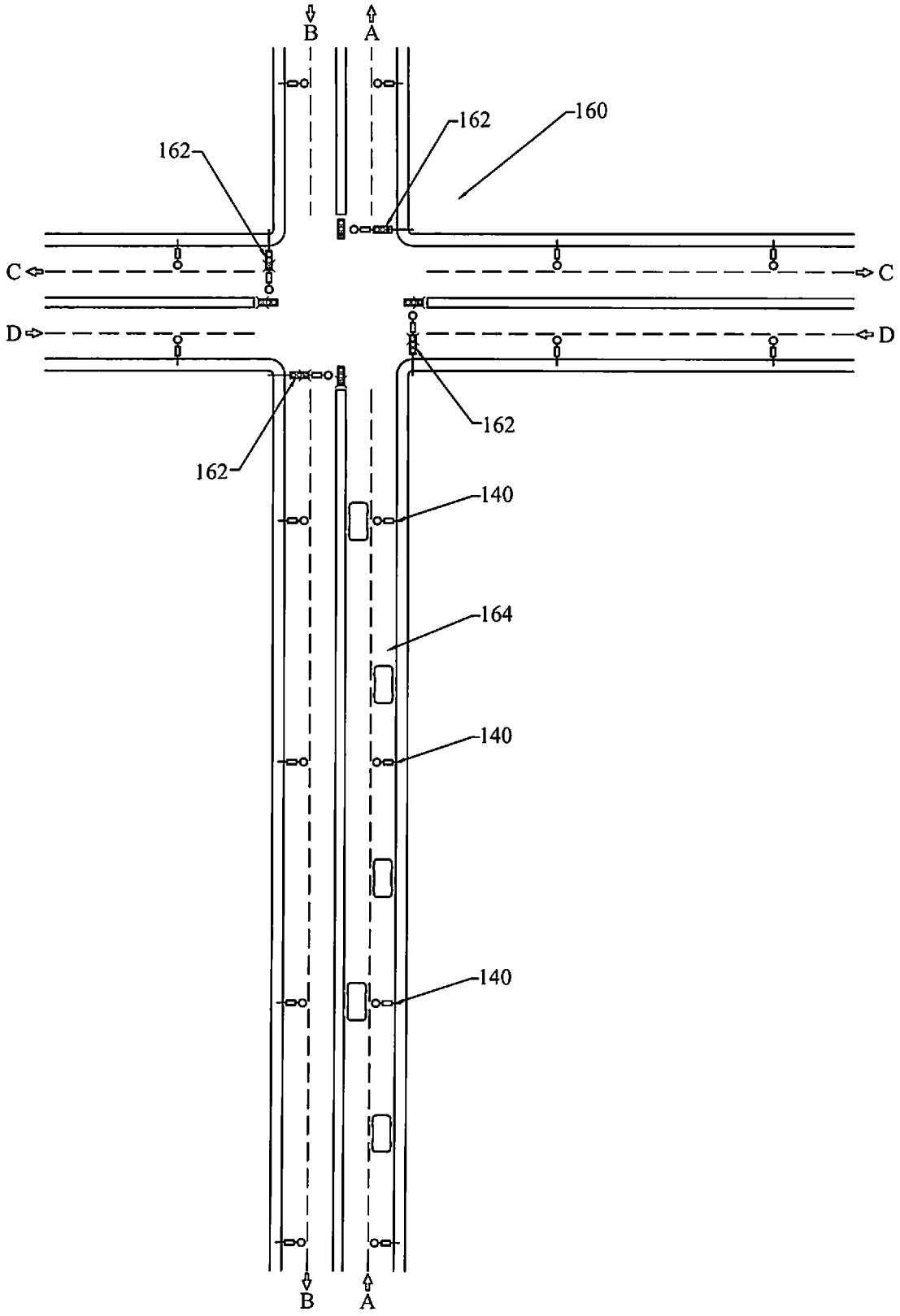
FIG. 16 is a top view of an embodiment of an intermediate device structure/system in accordance with the present disclosure.

For example, as depicted in FIG. 16, mechanical eye 60 on each IDS 10 may be configured to monitor vehicle flow, including sensing and recording vehicle load, speed, and direction of travel. Using these sensed results, each IDS 10 may calculate the anticipated arrival time of traffic flow at the next traffic intersection 160. This information may then be communicated to neighboring intersection traffic signal controllers 162 that can utilize this information to control the flow of traffic in the most efficient manner. Also, the controller 162 can transmit information to electronic boards (not depicted) along the path of travel to the intersection, broadcasting the travel speed needed for passing vehicles to enter the intersection on a green light. Utilizing IDS 10 in this way, may reduce stop and go traffic, accidents, noise, pollution, and vehicular and roadway wear and tear. As depicted, FIG. 16 shows IDSs 10 along lane A of roadway 164 sensing vehicles traveling on lane A toward intersection 160. IDSs 10 at other locations along lanes B, C and D sense that there is no vehicle traffic within these lanes B, C, or D. Using this collective information, shared between IDSs 10 and from IDSs 10 to controllers 162, traffic light controllers 162 may maintain a green light for lane A, for vehicles thereon traveling toward the intersection 160.

A feature of IDS 10 is the capability to collect environmental conditions data via mechanical eye 60 and relay the data to local processor 124 and/or remote processors. The data collected by mechanical eye 60 may include, but is not limited to, parking stall occupancy, a traffic count, vehicle load density analysis, time of day activity logging, and photographic and thermal imagery. The processed data obtained by mechanical eye 60 with or without additional information processed from other non-camera devices within IDS 10 facilitate optimal operation of IDS 10. Another feature of IDS 10 is to function as a public announcement, sound, and alarming system through the provision of audio input/output via mechanical ear 86 and speaker 108 (mechanical voice). Additionally, mechanical ear 86 and speaker 108 (mechanical voice) may be networked with other input/output onboard environment data collection, assessment, and operational devices, and have remote communication capability.

Figures 17A, 17B, 17C:
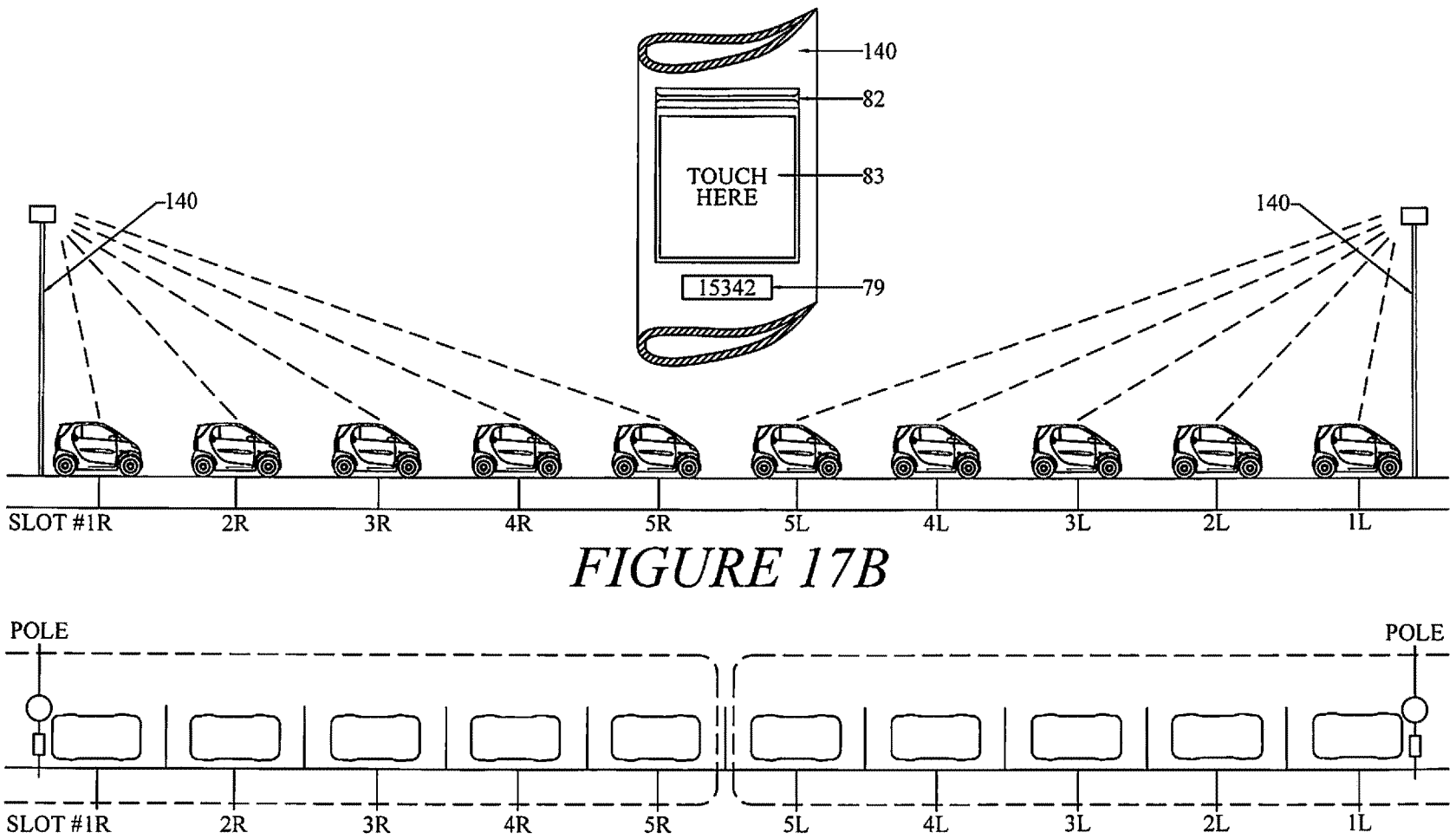
FIG. 17A is a cut away view of components of an embodiment of an intermediate device structure/system in accordance with the present disclosure.
FIG. 17B is a side view of components of an embodiment of an intermediate device structure/system in accordance with the present disclosure.
FIG. 17C is a top view of components of an embodiment of an intermediate device structure/system shown in FIG. 17B, in accordance with the present disclosure.

For example, as depicted in FIGS. 17A-C, smart poles 140 may be configured in a parking lot to administer parking lot activities and fees. Each smart pole 140 may have configured thereon an IDS 10, including mechanical eye 60. Each IDS 10 may be configured to monitor a specific number of parking stalls, such as 1R to 5R and 1L to 5L. Unique pole ID 79 may be displayed on pole 140. When a vehicle covers a specific stall, the driver, using a user-interface 83 touch panel on pole 140, associates the car stall location, 1R to 5R or 1L to 5L, with the time needed for parking. The driver may then pay the needed or required amount for parking by swiping a credit card in the provided metering device 82. If time expires and/or the car is parked without paying the fee, the mechanical eye 60 may detect the presence of the car and the IDS 10 may communicate with a local or remote meter maid and/or record the vehicle's license plate. On the other hand, if the driver has a subscription and employs an on-board card or RFID tag that is carrying credit and is providing a signal that is readable by an RFID reader 102 (or other similar signal reader technology) mounted on the IDS 10, IDS 10 may authorize an automatic charge to the on-board card or tag (or account associated therewith) for the amount of money corresponding to the parking duration.

In summary, embodiments described above address a number of the mechanical, thermal, electrical, airborne, and architectural challenges that are commonly associated with community roadways, intersections, walkways, and publicly accessible paths. Furthermore, the mechanical arrangement and electronics assembly of IDS 10 may assume partial or full control over the ambient environment in the vicinity of the IDS, integrating operational logic traditionally associated with isolated disciplines' networks of traffic flow, first response, crowd control, parking monitoring, public safety, air quality monitoring devices, input/output audio devices, temperature and humidity devices, security and normal operation monitoring cameras, occupancy sensors, lighting controls, and so forth. Consequently, the IDS 10 including the mechanical arrangement and the electronics assembly yields significant improvements in terms of the integration of a variety of disciplines associated with community roadways, intersections, walkways, and publicly accessible paths. Moreover, IDS 10 accomplishes all of these without compromising the structural integrity of existing structures (i.e., illumination poles 2) already owned by the community, municipality, and/or citizenry.

While the principles of the disclosed subject matter have been described in connection with specific apparatus configurations described above, it is to be clearly understood that this description is made only by way of example and not as a limitation on the scope of the disclosed subject matter. For example, embodiments may be implemented in systems having other architectures as well. The various functions or processing blocks discussed herein and illustrated in the Figures may be implemented in hardware, firmware, software or any combination thereof. Further, the phraseology or terminology employed herein is for the purpose of description and not of limitation.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. An intermediate device system for an illumination pole comprising a mast arm coupled to a luminaire, the intermediate device system comprising:

a base member having a first end and a second end and a through bore in the base member from the first end of the base member to the second end of the base member, wherein the mast arm of the illumination pole is coupled within the through bore at the second end of the base member;

a coupler arm having a first end and a second end and an axial length defined between the first end and the second end with a through bore extending along the axial length from the first end to the second end of the coupler arm, the second end of the coupler arm being coupled within the through bore at the first end of the base member and extending therefrom, such that the through bore of the coupler arm is coaxial with the through bore of the base member, wherein the coupler arm:

functionally engages the luminaire of the illumination pole; and is separated from the mast arm by the base member such that the intermediate device system is configured in line between the mast arm and the luminaire;

a housing configured to functionally engage and be mechanically supported by the base member, the housing defining a cavity therein; and an electronic assembly within the cavity; wherein the electronic assembly further comprises a communication unit, a power management and distribution unit, and a control unit, the electronic assembly being configured to govern power and data connectivity of electronic components of the intermediate device system.

2. The intermediate device system of claim 1, further comprising wiring for power and signal connectivity, wherein the wiring runs within the through bore of the base member and within the through bore of the coupler arm.

3. The intermediate device system of claim 2, wherein the base member defines therein a base member opening, and wherein the housing defines therein an opening that communicates with the cavity, the base member opening and the housing opening overlapping one another to permit the wiring in the through bore of the base member to electrically couple to the electronic assembly in the cavity.

4. The intermediate device system of claim 2, wherein the base member first end and the coupler arm second end are fixedly coupled to one another, and the through bore of the base member and the through bore of the coupler arm are axially aligned.

5. The intermediate device system of claim 2, wherein the through bore of the base member is configured to receive and functionally engage the mast arm of the illumination pole, and wherein the first end of the coupler arm is configured to be inserted into a bore of the luminaire to functionally engage the luminaire.

6. The intermediate device system of claim 1, wherein the housing further comprises a housing body and a housing covering, the housing covering being configured to releasably couple to the housing body.

7. The intermediate device system of claim 1, wherein the housing further comprises one or more fins on an exterior surface thereof, the fins being spaced apart from one another for heat dissipation.

8. The intermediate device system of claim 1, wherein the housing further comprises one or more vents in an exterior surface thereof for ingress and egress of air while resisting ingress and egress of moisture and dust.

9. The intermediate device system of claim 1, wherein the housing further comprises one or more data and power connectivity points in sidewalls thereof that facilitate coupling of auxiliary electronic devices to the electronic assembly.

10. The intermediate device system of claim 3, wherein the wiring electrically couples the electronic assembly to one or more auxiliary devices positioned on an exterior surface of the housing, on the illumination pole, or below a ground surface near the illumination pole, the electronic assembly being configured to control power and data connectivity of the one or more auxiliary devices through the wiring.

11. The intermediate device system of claim 1, the housing further comprising an external channel in a bottom surface of the housing, the external channel being configured to releasably engage the base member.

12. The intermediate device system of claim 1, wherein the electrical components comprise one or more processors, one or more power sources, one or more sensory devices, and one or more wireless communication devices.

13. An intermediate device system for an illumination pole comprising a mast arm coupled to a luminaire, the intermediate device system comprising:

a housing defining a cavity therein, the cavity being configured to hold an object;

a base member having a first end, a second end, and a through bore, the base member configured to engage and mechanically support thereon the housing, wherein the second end of the base member is configured to functionally engage the mast arm of the illumination pole; and a coupler arm having a cylindrical shape with a first end, a second end, and a through bore running from the first end to the second end, the second end of the coupler arm being coupled to the first end of the base member within the through bore of the base member such that the through bore of the coupler arm is coaxial with the through bore of the base member, and the coupler arm extending from the base member wherein the coupler arm is:

configured to functionally engage the luminaire of the illumination pole; and separated from the mast arm by the base member such that the intermediate device system is configured in line between the mast arm and the luminaire; wherein the object is an electronic assembly electrically coupled to line power of the illumination pole; wherein the electronic assembly further comprises a communication unit, a power management and distribution unit, the electronic assembly being configured to govern power and date connectivity of auxiliary components of the intermediate device system, the auxiliary electronic components being configured to be releasably electronically and mechanically coupled to the intermediate device system.

14. The intermediate device system of claim 13, wherein the auxiliary devices further comprise one or more of an optical device, a microphone, a speaker, a photocell, a photovoltaic cell, a radar sensor, a RFID sensor, a radiation sensor, and an air quality sensor.

15. A method of forming a smart illumination pole comprising a mast arm and a luminaire, the method comprising:

removing a luminaire from a mast arm of an illumination pole;

inserting an intermediate device system on the mast arm, wherein the intermediate device system comprises:

a housing defining a cavity therein, the cavity being configured to hold an electronic assembly;

a base member having a first end, a second end and a through bore, the base member configured to engage and mechanically support thereon the housing, wherein the second end of the base member is configured to functionally engage the mast arm of the illumination pole; and a coupler arm having a cylindrical shape with a first end and a second end, and a through bore running from the first end to the second end, the second end of the coupler arm being coupled to the first end of the base member within the through bore of the base member such that the through bore of the coupler arm is coaxial with the through bore of the base member, and the coupler arm extending from the base member, wherein the coupler arm is:

configured to functionally engage the luminaire of the illumination pole; and separated from the mast arm by the base member such that the intermediate device system is configured in line between the mast arm and the luminaire;

coupling the luminaire to the intermediate device system; and electrically coupling the electronic assembly to pre-existing line power of the illumination pole the electrically coupling the intermediate device system further comprises: electrically coupling auxiliary electronic devices to the intermediate device system; converting the pre-existing line power to low-voltage power; controlling the distribution of low-voltage power to each of the auxiliary electronic devices.

16. The method of claim 15, the electrically coupling the intermediate device system further comprises:

electrically coupling the luminaire to the intermediate device system;

converting the pre-existing line power to low-voltage power to the luminaire; and communicating in real-time with local devices and remote clients.

17. An intermediate device system for a pole comprising a mast arm, the intermediate device system comprising:

a base member having a first end and a second end and a through bore in the base member from the first end of the base member to the second end of the base member, wherein the mast arm of the pole is coupled within the through bore at the second end of the base member;

a coupler arm having a first end and a second end and an axial length defined between the first end and the second end with a through bore extending along the axial length from the first end to the second end of the coupler arm, the second end of the coupler arm being coupled within the through bore at the first end of the base member and extending therefrom, such that the through bore of the coupler arm is coaxial with the through bore of the base member;

a housing configured to functionally engage and be mechanically supported by the base member, the housing defining a cavity therein; and an electronic assembly within the cavity wherein the electronic assembly further comprises a communication unit, a power management and distribution unit, and a control unit, the electronic assembly being configured to govern power and data connectivity of electronic components of the intermediate device system.

* * * * *